US012054890B2

(12) United States Patent
Csepke et al.

(10) Patent No.: US 12,054,890 B2
(45) Date of Patent: Aug. 6, 2024

(54) SLEEPER

(71) Applicants: Robert Csepke, Balatonakarattya (HU); Istvan Martonffy, Budapest (HU); Tamas Szorad, Kecskemet (HU); Janos Csupor, Kecskemet (HU)

(72) Inventors: Robert Csepke, Balatonakarattya (HU); Istvan Martonffy, Budapest (HU); Tamas Szorad, Kecskemet (HU); Janos Csupor, Kecskemet (HU)

( * ) Notice: Subject to any disclaimer, the term of this patent is extended or adjusted under 35 U.S.C. 154(b) by 781 days.

(21) Appl. No.: 17/255,081

(22) PCT Filed: Jun. 25, 2019

(86) PCT No.: PCT/HU2019/000022
§ 371 (c)(1),
(2) Date: Dec. 22, 2020

(87) PCT Pub. No.: WO2020/002957
PCT Pub. Date: Jan. 2, 2020

(65) Prior Publication Data

US 2021/0269984 A1 Sep. 2, 2021

(30) Foreign Application Priority Data

Jun. 27, 2018 (HU) ..... P1800227

(51) Int. Cl.
*E01B 3/40* (2006.01)

(52) U.S. Cl.
CPC ..... *E01B 3/40* (2013.01)

(58) Field of Classification Search
CPC ..... E01B 3/00; E01B 3/28; E01B 3/30; E01B 3/36; E01B 3/38; E01B 3/40
See application file for complete search history.

(56) References Cited

FOREIGN PATENT DOCUMENTS

| | | | | |
|---|---|---|---|---|
| EP | 1573133 | | 9/2005 | |
| FR | 2121204 | | 8/1972 | |
| KR | 20160001011 | | 3/2016 | |
| KR | 20160001011 U | * | 3/2016 | ..... E01B 1/002 |
| WO | 2005100692 | | 10/2005 | |

OTHER PUBLICATIONS

European Patent Office, International Search Report and Written Opinion in PCT Application No. PCT/HU2019/000022, Nov. 19, 2019.

* cited by examiner

*Primary Examiner* — Robert J McCarry, Jr.
(74) *Attorney, Agent, or Firm* — Wood Herron & Evans LLP

(57) ABSTRACT

The invention is a sleeper having a sleeper body (10), and the sleeper body (10) has a top side (15) and a bottom side opposite the top side (15), and intended rail laying band regions are on the top side (15), and at least two intended seating regions, each being applicable for a respective rail fastening (18), corresponding to and overlapping with each of the intended rail laying band regions. In the sleeper body (10) a through-opening (14) arranged between adjacent intended seating regions corresponding to the same rail laying band region, extending farther in both lateral directions than one or more intended rail laying band regions, encompassed by the sleeper body (10), and interconnecting the top side (15) and the bottom side of the sleeper body (10) is formed in the sleeper body (10).

14 Claims, 12 Drawing Sheets

SLEEPER

This application claims priority, under Section 371, and/or as a continuation under Section 120, to PCT Application No. PCT/HU2019/000022, filed on Jun. 25, 2019, which claims priority to Hungarian Application No. P1800227, filed on Jun. 27, 2018.

TECHNICAL FIELD

The invention relates to a sleeper, particularly to a railway sleeper.

BACKGROUND ART

Improving of railway transport have led to a rapid increase of train velocity and vehicle axle loads, putting increased loads on the track and on the vehicles. Besides that, intervals without train traffic that are available for track maintenance have become much shorter.

To allow for such a huge performance increase in rail traffic (both freight and passenger), in addition to fulfilling the relevant safety regulations it is also required that the vehicles have good high-velocity ride quality and stability, and that the tracks withstand the increased loads to a sufficient degree.

It follows from the above that with increasing loads the dynamic forces exerted on the railway superstructure also increase; the corresponding energy values are proportional to the square of velocity. One of the ways of providing good energy transfer is the construction of so-called concrete plate or asphalt-superstructures (instead of applying conventional crushed-stone ballast) that are dimensioned for higher forces and have increased rigidity. However, the construction costs of such track structures are typically higher. Such construction costs can be primarily justified—and the investment can even have a remunerative investment in the short or medium term—in the case of tunnels or very high-velocity (v>250 km/h) lines.

In the case of other railway tracks, in non-inner-city sections of conventional, suburban, urban or public road railway (tramway) lines, approaches applying crushed stone ballast are often preferred even nowadays. In order to counter the typically aggressive, corrosive effects of the urban environment, and to assume the increased traffic loads, the tracks are preferably engineered with higher structural reserve factors. As with other structures subject to high loads, this can involve applying higher-weight rails—nowadays, rails with typical specific weights of even 54-60 kg/m—a higher (thicker) ballast, a substructure-reinforcing layer, sleepers of higher weight capable of providing greater ballast resistance, and also resilient components.

In addition to the dynamic effects of moving vehicles, more extreme weather conditions may also have adverse effects on the geometry of the tracks and their prolonged structural stability. Along straight sections of gapless tracks, due to extreme thermal effects, there can occur significant thermal expansion (dilatation) forces and stresses in rails with greater cross-sectional area. These forces are transferred to the crushed stone ballast, and eventually to the earthwork, by the sleepers, via the rail fastenings securing the rails to the sleepers. If this force exceeds the maximum lateral ballast resistance of the track structure, the rails undergo an abnormal and permanent displacement ("jumps out"), resulting in a pronounced wave-shaped distortion of the geometrical shape of the rail that poses a risk of accident.

The tracing of the crushed stone-ballast tracks of suburban and urban railway lines needs to be adapted to the more tightly and densely built-up environments. This is also reflected in the need for building curves with lower radius. In the case of curves with a relatively low radius of a few 100 meters (typically R=100-300 m), the radial displacement of the curve due to the winter-summer temperature differential can cause radial displacements of approximately 10 cm in the case of jointed tracks, but especially in the case of tracks with gapless construction. This condition poses a danger to traffic safety, reduces the allowed velocity, and results in significant extra maintenance costs for the operator of the track. This applies especially to conventional tracks with wooden sleepers (ties). Experience indicates that, because the material of the wooden sleepers is softer than the stones in the crushed stone ballast, the stones are pressed into the bottom side of the wooden sleeper. This has a favourable effect as far as the lateral ballast resistance of the track is concerned, because it improves the "cooperation" of the sleepers and the stones, they hang on each other. However, this effect is significantly diminished after the vehicle has passed. Because the weight of wooden sleepers is much lower (⅓) compared to concrete sleepers, it is more preferred to apply the higher-weight concrete sleepers because they provide greater stability even without vehicle load. Lateral ballast resistance is also provided by the friction between the lateral walls of the sleepers and the stones of the gravel ballast. This is more favourable in the case of concrete and steel sleepers than wooden sleepers because the friction coefficient between the impregnated material of the wooden sleeper and the stones is much lower. As a third factor of lateral ballast resistance, the mass of the crushed stones to be displaced by the end faces of the sleeper also has to be taken into account.

In the case of wooden sleepers, reinforced concrete sleepers and steel sleepers configured in a conventional manner, i.e. with parallel lateral walls and without a narrowed middle section, differences in lateral ballast resistance are the result of almost exclusively the differences in sleeper weight.

Tracks constructed utilizing conventional sleepers are characterised by a relatively low "frame rigidity", which can be increased only to a small extent by the more careful choice of rail fastenings (rail anchoring). This characteristic also deteriorates the possibility of effectively providing lateral ballast resistance along the longitudinal extension of the track.

In order to lengthen the intervals between the necessary maintenance works of the railway superstructure, it is required to prevent the restructuring of the crushed stone ballast to the greatest possible extent, to prevent the ballast stones from being crushed, and to prevent the displacement of the sleepers and the overloading of the substructure, thereby stabilizing track geometry. This holds true especially for curves with a lower radius, but also for longer straight sections of gapless tracks comprising large cross-section rails.

A number of approaches are known for increasing the length of maintenance-free intervals between maintenance works. One type of the approaches involves the application of sleepers having wider bottom sides (support surfaces). The description published in EP 1 767 696 A1 discloses such an approach, comprising a wide sleeper made of tensioned reinforced concrete. In this approach, a widened variant of the conventional sleeper having a single rail fastening on each side, is applied that has a dual diapered shape, and has a variable cross section along the longitudinal axis (as far as its width and height are concerned). This configuration allows for the application of conventional tamping machines during track adjustment works.

A reinforced concrete sleeper with a similar configuration is disclosed in EP 1 055 777 A2, wherein the sleepers are so wide that they almost contact each other, so there is not enough room between them for performing conventional tamping/adjustment works. For the tamping/adjustment of such sleepers a specially modified machine is required that is capable of performing tamping at the front side of the sleepers, which significantly increases costs and reduces the flexibility of work organisation.

A number of approaches are known for increasing the resistance against transverse displacement, and for increasing frame rigidity. In EP 1 114 221 B1 a so-called frame sleeper is disclosed. The approach is satisfactory as far as frame rigidity and lateral ballast resistance are concerned, but, due to the relatively small surface area of the bottom load transfer surfaces, can transfer overly high loads to the substructure, which is undesirable. The grid arrangement of the rail fastenings has non-uniform spacings, which poses problems for the machines performing adjustment, and also generates large bending stresses in the structure, potentially resulting in an increased tendency to crack, especially at the corners of the neck members interconnecting the two transverse beams.

A similar approach is presented in the patent description EP 1 573 133 B1 that also discloses a frame-type sleeper. This approach also has highly varying cross-sectional dimensions, which adversely affects the internal stress distribution of the structure. This approach also has the disadvantage that the transverse beams are interconnected by neck members running under the rails and parallel to them. A maximum torque location is produced in the transverse beams under the rails, while at the same time torsional loads in an opposite direction are generated by these torques at precisely the cross sectional location of the peak stress, thus "trying to break off" the connected portions of the transverse beam from the end of the neck member. Therefore, rapid failure from cracking can be predicted also in the case of this configuration.

In EP 0 555 616 A2, a prefabricated concrete plate for a railroad superstructure supporting framework is disclosed for example. The cross-sectional configuration of this approach has complex geometrical shapes, with rail fastening and the affixing of the elements to each other being performed applying dedicated means.

In the system disclosed in the patent EP 1 039 030 B1 that also applies prefabricated concrete plates, large cross-section openings arranged in a row (unilinearly) along the longitudinal axis of the plates are shown. Concrete is injected into the openings after inserting therein the steel reinforcement bars (cf. FIGS. 1 and 2 of the document, the arrangement of the reinforcement bars is shown in FIG. 2). This ensures that the concrete plates are affixed to the base layer. This is unfavourable from the aspect that the anchoring rebar assembly inserted into the opening has to be dimensioned for assuming the high loads posed by the longitudinal forces of braking or accelerating railway vehicles. Also, significant shear and bending loads are concentrated on this cross section near the corners of these openings.

Another approach is disclosed in the patent U.S. Pat. No. 6,764,022 B2, wherein a structure that is laid on an asphalt base layer—but that can also be interpreted as a rigid track plate—is implemented applying wide-base prefabricated reinforced concrete sleepers configured in a fashion similar to the above described approaches. In this approach, the sleepers are affixed to the base layer by "pins" injected through the wide sleeper, into cavity pockets that were previously made (by boring) in the asphalt layer Longitudinal forces are balanced out by friction between the bottom side of the pins and concrete sleepers on the one hand and the asphalt base layer on the other.

In GB 14,043, GB 2 436 842 A, JPH 09273102 A, U.S. Pat. Nos. 1,704,545 and 3,762,641 such sleeper systems or assemblies are disclosed wherein openings adapted to encompass the rails are arranged at certain portions of the sleepers. In all of the approaches according to these documents, the sleeper, so for example the plate applied for implementing the sleeper, comprises as a major structural component a portion extending under the rails. During the operation of the rail track, this portion can be subjected to high torsional loads. Sleepers with a similar structure are disclosed in AT 377 806 and AT 410 226 B.

A structural component is arranged under the rails also in KR 100702251 B1, wherein a sleeper having an essentially "tuning fork" shape is disclosed. Accordingly, in the approach according to the document, two fork-shaped portions, each extending under a respective rail, are interconnected at the middle of the sleeper by a thin and straight member. Disadvantageously, the support surface on the foundation of the sleeper according to the document is very low.

In KR 200391816 Y, essentially two adjacent conventional sleepers are joined to each other. The central interconnection portion, wherein there is arranged a sound insulation member, extends between the rails as far as the rails themselves. This approach comprises height-adjustment members applied for the sleepers.

A concrete sleeper having an essentially "H" shape is disclosed in WO 2010/114280 A2. The central portion adapted for interconnecting the two "branches" of the sleeper is disadvantageously very narrow relative to the width of the sleeper, while the branches of the sleeper are also narrow with respect to the extension measured in the direction of the rail of the opening between them, so the support surface of the sleeper according to the document is relatively small.

In KR 20160001011 U a sleeper comprising two fastening locations is disclosed wherein an additional opening is formed under the rails. A significant disadvantage of this approach is the extremely complex configuration (lateral protrusions, recesses; the sleeper has variable thickness, and has protrusions, made integral with its material, for receiving the rails).

In U.S. Pat. No. 5,312,038 a sleeper is disclosed that comprises a resilient layer arranged on a certain part.

In view of the known approaches, there is a demand for a sleeper that performs its function more effectively compared to the known approaches, and that, thanks to its configuration, permanently withstands the weather and other environmental effects, particularly the effects caused by railway vehicles running along the track attached to it.

DESCRIPTION OF THE INVENTION

The primary object of the invention is to provide a sleeper which is free of disadvantages of prior art approaches to the greatest possible extent. The object of the invention is therefore to provide a sleeper that performs its function more effectively compared to the known approaches, and that, thanks to its configuration, permanently withstands the weather and other environmental effects, particularly the effects caused by railway vehicles running along the track attached to it. A further object is to provide as effective vertical load transfer and transverse push force assumption as possible.

A further object of the invention is to provide a (railway) sleeper, and preferably a track plate family for railway superstructures including the sleeper that can be universally applied, i.e. with a crushed stone ballast and with other, rigid foundation types (the illustrated embodiments of the sleeper according to the invention may be called a track plate or a plate-type sleeper).

A particular object to be achieved by the invention is to provide that, in addition to utilizing it with a crushed stone-ballast implementation, the same sleeper according to the invention can also be applied as a rigid-foundation sleeper (track plate), preferably allowing for utilizing the same components for crushed stone-ballast and rigid-plate tracks at the construction of engineering structures (bridges, tunnels). Another object to be achieved is that operations related to manufacturing, transport and installation, and also to maintenance, adjustment, tamping can be performed without any modifications, in a similar fashion to conventional, crushed stone-ballast tracks, and furthermore, that vertically resilient transition sections necessarily included between crushed stone-ballast and rigid-foundation track sections can also be simply implemented applying the members of the sleeper family. These can be implemented by laying sleepers having gradually decreasing dimensions and a correspondingly fewer number of openings already in the crushed stone-ballast section. A resilience transition is thereby produced such that the support surface area of the track gradually decreases from the rigid section (larger surface area), so its vertical rigidity also decreases, and the sag (downward bend) of the track gradually increases.

The objects of the invention can be achieved by the sleeper according to claim 1. Preferred embodiments of the invention are defined in the dependent claims.

According to the invention we have recognised that in order to fulfil the above mentioned combined object targeted at reducing the frequency of the maintenance, the lateral ballast resistance and frame rigidity have to be increased, while at the same time reducing dynamic loads transferred by the sleepers to the crushed stone ballast and thus to the earthwork-top as much as possible. The unlimited increase of sleeper mass is not feasible, because, in the case of for example wooden sleepers or sleepers it is not even possible (or is exceedingly cumbersome) due to the standardised dimensions at rail fastening distances. Even with sleepers made of reinforced concrete, a number of economical issues related to the aspects of manufacturing, transport, installation and maintenance would be raised by increased material consumption. Such are the major considerations with steel and synthetic sleepers, too.

As it will be detailed below, it is therefore much more preferable to take such measures that—instead of causing a significant mass increase—involve only a small mass increase but effectively provide for a much more preferable, more favourable geometrical configuration. The ballast bed of the railway tracks constructed utilizing the prefabricated sleepers according to the invention applied in the track plate family that can be implemented according to the invention requires low maintenance, and allows a particularly effective and favourable force transfer between the crushed stone ballast and the sleeper, providing vertical force transfer along a larger surface area and an improved assumption of transverse push forces.

According to a further recognition motivating the sleeper according to the invention it has been recognised that a very favourable (lateral) ballast resistance can be provided for the track ballast made of crushed stone in case the frontal surface area of the sleeper is increased significantly, while at the same time leaving the thickness (virtually) unchanged, or even decreasing it relative to a conventional sleeper. The above described lateral ballast resistance is to be measured transversely to the longitudinal direction of the rails. This effect can be exploited to the greatest possible extent by fully omitting the gap(s) between (two or more) adjacent sleepers, i.e. by providing plates with sufficiently large frontal and support surface area. A larger sleeper surface area is desirable also in order to decrease the loads on the substructure.

However, in the case of conventional crushed stone-ballast railway tracks, in order to retain the ability to perform tamping, it is still required to provide insertion locations for the tamper hammers (adjustment hammers). Also, to achieve a more favourable stress distribution, the cross-sectional configuration is as uniform and homogeneous as possible, both in the vertical (i.e. as seen from above) and in the horizontal senses (i.e. in the direction of the plane of the sleeper). According to our recognition, therefore, the most favourable geometry can be achieved by a plate-type sleeper having a constant height dimension (by a flat sleeper), on which there are openings at the insertion locations of the tamper hammers, while the frontal surface thereof being continuous also between the rail fastenings or supports. Consequently, the sleeper according to the invention can comprise various types of rail fastening grid arrangements, i.e. can have 2, 3, 4, . . . rail fastenings arranged along the longitudinal direction. Longer sleepers can have a major role for example in level crossings or resilience transition sections of the track.

In contrast to the conventional sleepers described above, the sleeper according to the invention is typically not a "slender" structure. The known approaches are typically based on some kind of "interconnection" made between conventional sleepers, retaining the statically "slender" geometry. In a number of known approaches a connection member is arranged also under each rail between adjacent rail fastening locations, which makes it impossible to perform effective ballast tamping by conventional means. In a conventional tamping operation, the hammers move in a direction parallel to the rails. The sleeper according to the invention does not require special tamping, i.e. it is not necessary to reach under the foot of the rail, and there is also no need to apply a specially configured tamping machine undergoing a motion perpendicular to the rail axis for performing the tamping operation. If a connection member was formed also under the rails, the hammers would have to move perpendicular to the rails, i.e. rotated by 90 degrees, for an effective tamping operation. This would require a highly unique tamping machine (see for example the approach of EP 1055777 A2, wherein tamping can be performed utilizing a machine that is capable of tamping from the frontal side of the sleepers).

The illustrated embodiments of the sleeper according to the invention are therefore essentially plate-type sleepers comprising adjustment openings. It typically has a large surface area, and thus provides favourable load distribution. A special characteristic of the sleeper according to the invention is that, in addition to being utilized for crushed stone-ballast tracks it can also be applied as a prefabricated structure for concrete-plate tracks having a rigid foundation.

If the sleeper (the sleeper body thereof) is made of cast concrete (for example ferroconcrete, reinforced concrete, or even fibre-reinforced concrete—e.g. using synthetic macro-fibres and/or steel fibres); the manufacturing technology of the sleepers can be identical to the manufacturing of other, conventional prefabricated tensioned reinforced concrete sleepers and concrete plates, i.e. being made (cast) "upside down" applying a mould. In such a case, a formwork for the above mentioned adjustment openings (i.e. the openings for inserting the adjustment hammers) can be made such that due to the "upside down" orientation it widens towards the bottom side and constricts towards the top side, i.e. such that when the sleeper is removed from the formwork and is flipped to the use position, the openings are adapted to widen towards the top and constrict towards the bottom. The sleeper body can also be made of plastic or steel, in the case of which such a shape can also be formed during manufacturing, but the application of concrete—in embodiments wherein the sleeper body is made of concrete—has a number of advantages (cheap and simple manufacturing, durability, etc.).

In relation to that, it has been recognised that these openings can be suitable for providing anchoring to a foundation structure such that, in the case concrete is injected in them, they form a separate layer of the foundation. Another advantage of this solution is that the anchors thus produced along the line of the rails (in this case, the opening in which concrete is injected extends transversely under the rails) provide more favourable load transfer in the longitudinal direction compared for example to the approach disclosed in EP 1,039,030 B1, thus it is operable when the reinforcement is predominantly or fully omitted, and it gives a good solution for a simpler construction with for example synthetic macrofibre and/or steel fibre dosage, which can reduce construction costs, can provide time savings and mitigate organizational problems. Accordingly, a number of preferable configurations that differ in respect of the applied manufacturing technology, installation, or the material of the sleeper (reinforced concrete, steel, synthetic) can comply with the aspects of the invention.

By utilizing more than one sleepers according to the invention, a universal system of prefabricated railway sleepers (preferably plate-type sleepers) can be provided that is adapted to preferably provide a high geometrical track stability. Applying the sleeper according to the invention, therefore, a system of sleepers (preferably plate-type sleepers) equally suited to be laid on crushed stone ballast and a rigid foundation can be provided. The present invention therefore provides a satisfactory and universal solution for constructing both crushed stone-ballast tracks and tracks with rigid foundation utilizing the same system components. It can be equally applied for uninterrupted-flow track sections or in turnouts, and also for other, special track structures (rail dilatation structures, guard rail tracks, etc.).

The various different embodiments of the invention make up a family of sleepers having a number of identical basic features. The sleeper according to the invention can be made of concrete, reinforced concrete, polymer concrete, or optionally of a new synthetic material (for example, plastic), or in certain cases also of steel.

BRIEF DESCRIPTION OF THE DRAWINGS

Preferred embodiments of the invention are described below by way of example with reference to the following drawings, where.

MODES FOR CARRYING OUT THE INVENTION

Figure 1:
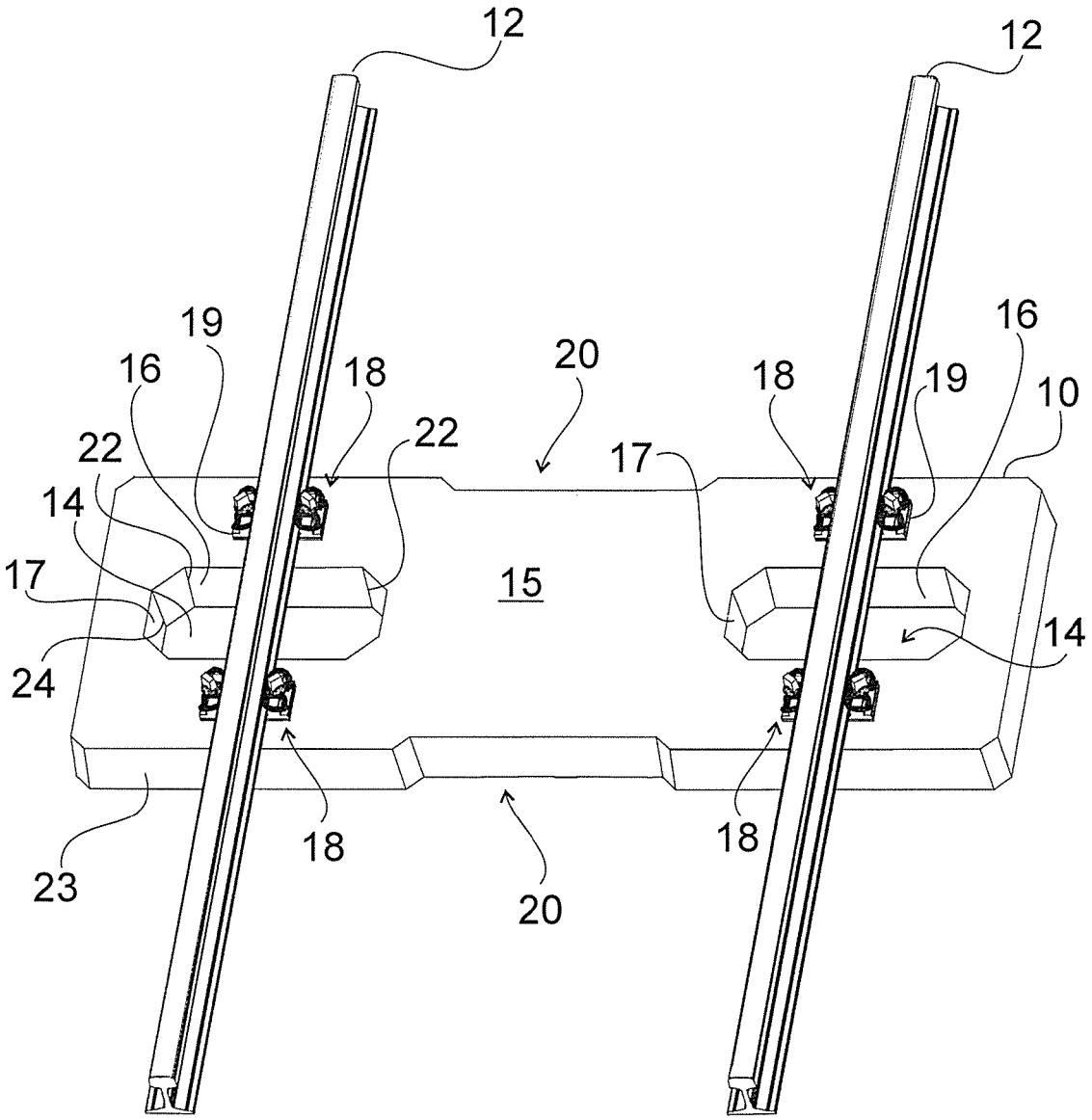
FIG. 1 depicts an embodiment of the sleeper according to the invention, showing rails being laid on the sleeper.
Figure 2:
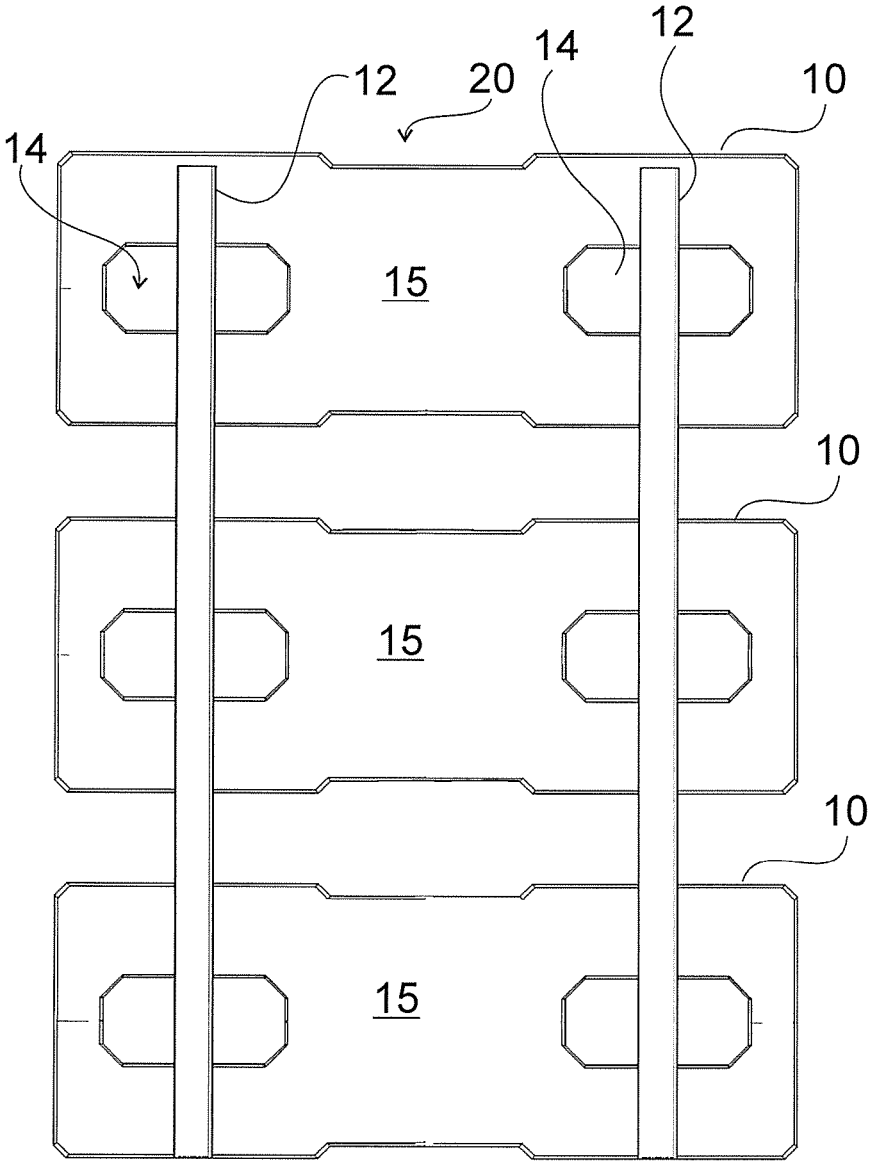
FIG. 2 illustrates, in top view, multiple instances of the embodiment of FIG. 1.

An embodiment of the sleeper (transverse sleeper) according to the invention is illustrated in FIGS. 1 and 2. In this embodiment, the sleeper has a first sleeper body 10 (the subject-matter of the invention may itself be called a sleeper body). The sleeper body 10 has a top side 15 and a bottom side opposite the top side 15 (in the figures, this latter side is obscured from view as it is the supported side; the sides can also be called first and second sides, but a sleeper naturally has a top side [facing outward] and a bottom side [supported]; the top and bottom sides lie opposite each other but are not necessarily parallel), and intended (envisaged, prevised, appointed) rail laying band regions are on the top side 15 (typically, one for laying and attaching each rail of the track [i.e. in sum, two regions], in relation to this see also the discussion below), and at least two intended (envisaged, prevised, appointed) seating regions, each being applicable for a respective rail fastening (see the rail fastening 18 in FIG. 1), correspond to and overlap with the intended rail laying band regions.

In this embodiment, furthermore, a first through-opening 14 arranged between adjacent (neighbouring) intended seating regions corresponding to the same rail laying band region, extending farther in both lateral directions than (overreaching, outreaching, overextending) one or more intended rail laying band region (has farther-extensions in both lateral directions compared to one or more intended rail laying band regions), encompassed (encircled, surrounded) by the sleeper body 10, and interconnecting the top side 15 and the bottom side of the sleeper body 10 is formed in the sleeper body 10.

The through-opening is dimensioned to allow the tamper hammers to operate in (extend into) them, at both sides of the rail laying band region. Accordingly, the through-opening is situated between adjacent intended seating regions corresponding to the same intended rail laying band region, and may extend over multiple intended rail laying band regions. In other words, such a through-opening is applied that is situated between intended seating regions that are adjacent with respect to a particular intended rail laying band region (as indicated by the above definition, the phrasing "situated between" means that it projects therein, while also extends farther than the intended rail laying band region in both directions) and correspond to one or more intended rail laying band regions; i.e. one or more through-opening is applied which extends across adjacent pairs.

The through-opening extends farther sideways in both directions than all of the one or more intended rail laying band regions (if a respective through-opening is arranged for each intended rail laying band region, then it extends out, in both lateral directions, from the region to which it corresponds). A single, common through-opening can be arranged for both rail laying band regions, or a separate through-opening can be included for each rail laying band region, as in the embodiments illustrated in FIGS. 1-7 (it is illustrated in the figures that, in case separate through-openings are arranged, these are preferably arranged in a row extending transversely with respect to the rail laying direction, because the rail fastenings of each rail of the track are also typically arranged in a respective row).

The intended rail laying band region is a region of the sleeper which can be covered, as seen from above, by a rail. For example, in the case of a sleeper having straight or indented straight sides (the latter is the sleeper according to FIG. 1) along a straight section the rail is set perpendicular to the side of the sleeper, in which position it defines a basic rail laying band region, which is rectangular for a straight-sided sleeper. However, for instance in the turnout illustrated in FIG. 8, or in a curve, the rail does not necessarily extend perpendicular to the side of a straight-sided sleeper, i.e. the arrangement can be slightly oblique (in both directions) with respect to the basic rail laying band region. In a curve, the slightly curving rails extend out also from the basic rail laying band region (in the middle, usually over the through-opening, the rail laying band region has a "bulge"; and extend out at the sides of the sleeper in a similar fashion as with the oblique arrangement), so the real (effective) intended rail laying band region is an essentially rectangular, band-like region that is wider than the basic rail laying band region (see below in relation to FIG. 9). In the following, on certain occasions this real (effective) rail laying band region is referred to as an intended rail laying band region, and the adjective "intended" is also omitted from the term "intended seating region" on many occasions. When the rail is placed on the intended rail laying band region, it will therefore cover a subregion thereof. The through-opening therefore extends out sideways, in both directions, from the basic rail laying band region and also from the (effective) intended rail laying band region.

Figure 9:
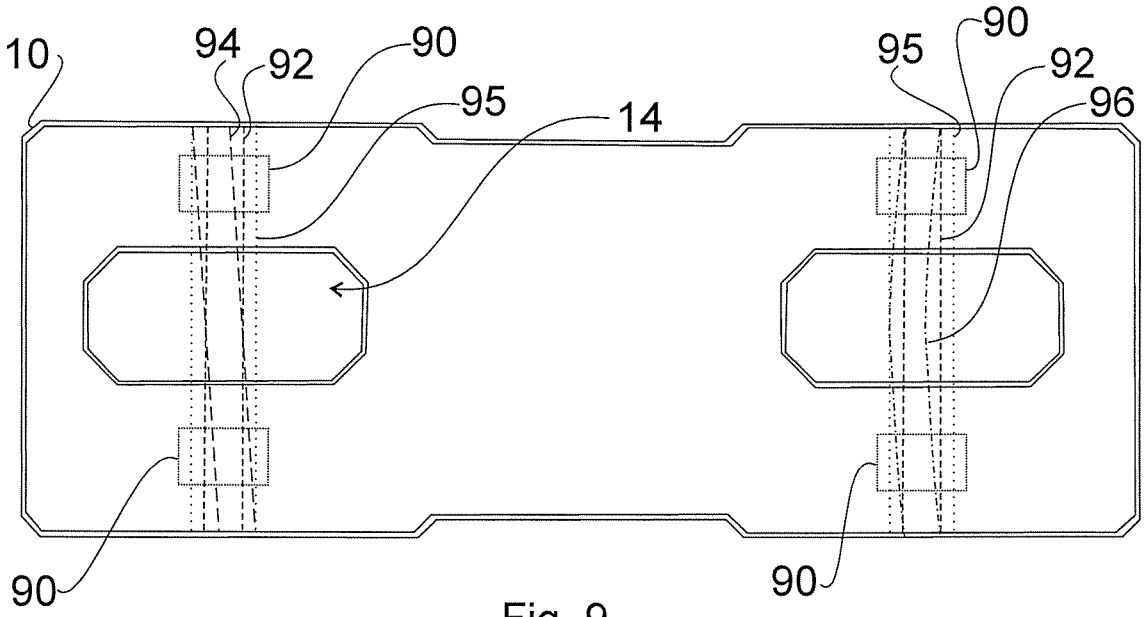
FIG. 9 is a schematic drawing illustrating an exemplary arrangement of the particular regions according to the arrangement of FIG. 2.

In relation to the concepts introduced above, reference is made to FIG. 9 that schematically illustrates an exemplary arrangement of the particular regions in the embodiment of FIGS. 1 and 2. On the left of FIG. 9 there is shown a first rail contour 92 (perpendicular to a respective side of the sleeper) with shorter dashed lines, and a second rail contour 94 that lies inclined with respect to it with longer dashed lines. The rail contour 92 coincides with the basic rail laying band region, while an intended rail laying band region 95, indicated by the dotted lines, is wider than that. The width of the intended rail laying band region 95 is determined by the oblique rail contour 94 and a curved third rail contour 96 (dashed-dotted lines) shown on the right of the figure (of course, in reality the curve may have a completely different arc), extending as far as the edge of the rail laying band region 95 (the rail laying band region 95 starts where the rail contour 94 intersects the edge of the sleeper body 10). The intended rail laying band region 95 is typically 50-150% (in an example, 100%) wider than the basic rail laying band region (of which the width is given by the width of the foot of the rail). Other rail arrangements can also be conceived within this region, as the intended rail laying band region 95 encompasses the possible rail arrangements, the rectangular intended rail laying band region 95 can be determined in this way—basically even in that case when only the rail contours 94 and 96 are taken into account.

In FIG. 9 a respective seating region 90, corresponding to the rail contour 92 is schematically shown in densely dotted lines on both sides of the through-opening 14. The seating regions would be located slightly differently for the rail contours 94 and 96. The seating regions 90 are shown schematically; they essentially correspond to the rail fastening 18, exemplifying the relative arrangement of the seating region 90 and the rail laying band region 95 (as shown in the figure, they overlap: each of the seating regions 90 extends over [has a greater width than] the oblong rail laying band region 95).

The basic rail laying band region and the real (effective) rail laying band region both have a typically oblong shape (even in the case of a raster allocation of two), of which the longitudinal direction defines a basic rail laying direction (the rail extends along this direction when arranged in the basic rail laying band region, i.e. for example on sleepers arranged along a straight track section). Accordingly, in other words the condition for the width (along the length of the rail) of the sleeper is the following: in the basic rail laying direction the top side 15 of the sleeper body 10 has a width along the basic rail laying direction that allows for positioning (receiving, arranging) at least two rail fastenings (corresponding to respective seating regions) along each rail laying band region. The seating region (seating subregion, support region) is a contiguous (connected) region along which the rail is supported by (i.e. seated on) the sleeper.

Accordingly, therefore, there are at least two seating regions being arranged on the sleeper according to the invention, along the longitudinal direction of the rail laying band region (i.e. in the basic rail laying direction), that is, i.e. the connection of at least two rail fastenings are allowed along each rail laying band region. The phrasing "each seating region is applicable for a respective rail fastening" is taken to mean the following. When the rail is fastened to the sleeper, the element to be seated on the sleeper at the rail fastening is arranged along the seating regions virtually present on the top side of the sleeper body. This is situated between the rail and the sleeper, in the case of the rail fastening 18 shown in FIG. 1, a fastening plate 19 is arranged on the seating region. The rail 12 is fastened to the top side of the sleeper body by seating it on the fastening plate 19. Some type of elastomer layer can be applied at the fastening plate also in this fastening solution, but an elastomer layer can also be arranged between the rail and the top side of the sleeper body when fastening the rail (in such a case the seating region and the portion of the rail laying band region that is to be covered by the rail are virtually coincident, i.e. the completely overlap each other), so this layer extends over the seating region. In this case, fastenings can be applied for example at the side of the rail.

Accordingly, therefore, the seating region can be applied for rail fastening, i.e. the rail fastening can be arranged such that an appropriate component seated on the seating region is applied.

For sleeper body configurations of other embodiments, see the subsequent figures. The above described features of this embodiment appear also in the other illustrated embodiments.

Taking into account the width of a rail, and also the requirement that there has to be room on the sleeper according to the invention for at least two rail fastenings along the rail direction width of the sleeper, according to the above it can be seen that the rail laying band regions have a shape that is elongated in the direction of the rail to be fastened, i.e. their longitudinal direction defines the basic rail laying direction.

Figure 6A:
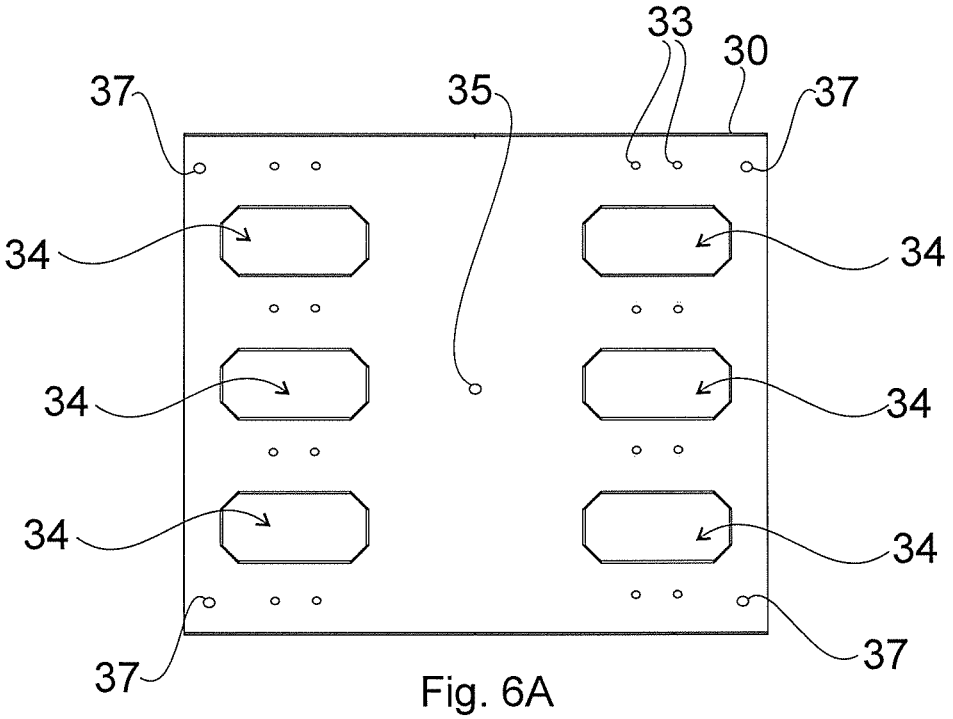
FIG. 6A is a top drawing illustrating a further embodiment of the invention.
Figure 6B:
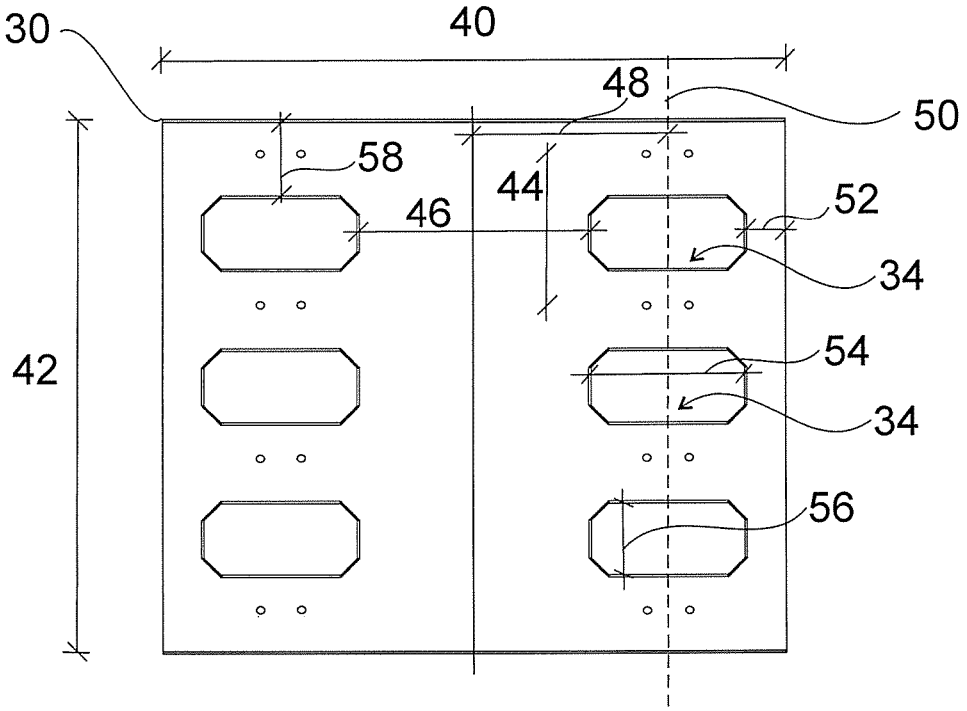
FIG. 6B shows the embodiment of FIG. 6A, indicating some more important distances.
Figure 7:
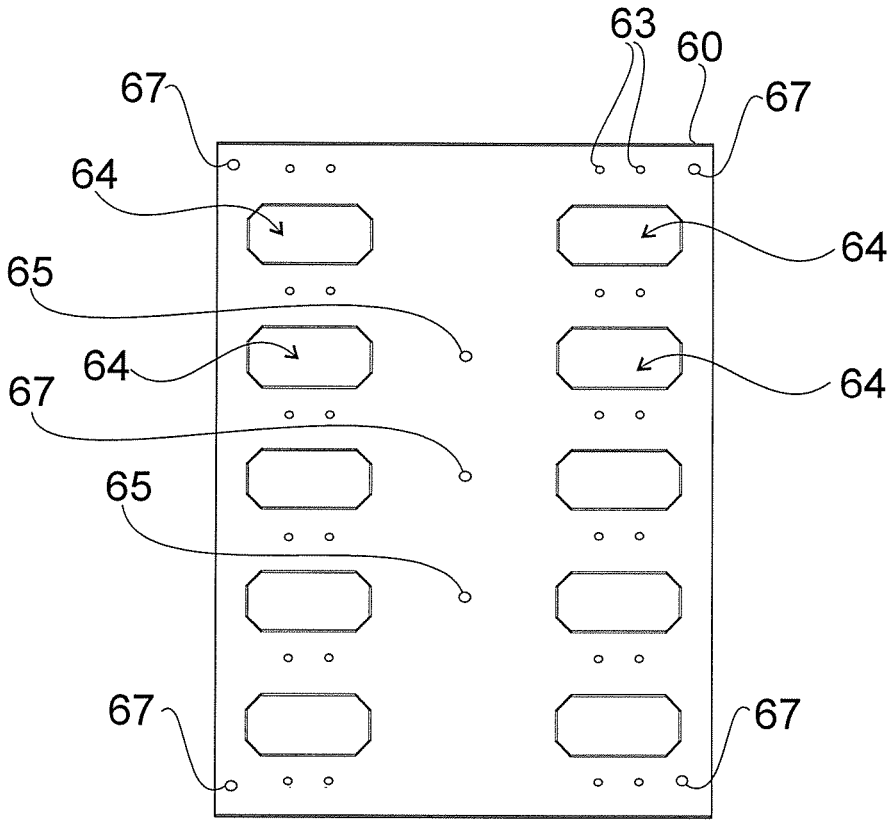
FIG. 7 is a top drawing illustrating a still further embodiment of the invention.

As far as the rail fastenings are concerned, the sleeper according to the invention is configured such that—taking into account the standard rail fastening spacings—it can accommodate at least two rail fastenings (two in the embodiment according to FIGS. 1 and 2, and more than two in other embodiments—see FIGS. 6A-7). The rail fastenings or fastening locations do not necessarily require preparation, but of course it is advantageous if the rail fastenings are prepared, for example, the necessary dowels are inserted into the sleeper. In addition to that, the bores required for rail fastening can also be made at the site where the sleeper is installed, even right before installation, in which case the rail fastening locations (and of course the rail laying band regions and the seating regions overlapping with them) exist only virtually on a sleeper according to the invention: the surface region that will receive the rail fastening upon installation can be defined. For sleepers applied at special locations it is advantageous if the bores are not prepared beforehand, as in such cases the fastening locations may have to be corrected on-site (cf. FIG. 8).

A rail laying band region corresponds therefore to such rails that are to be fastened to the sleeper utilizing a rail fastening (so for example not for a movable rail of a switch that will not be fastened to the sleeper). Therefore, the region over which a rail can be laid across the seating regions (that are in contact with the top side of the sleeper), and which thus overlaps with the seating region, is called the rail laying band region. This means that no rail laying band region will correspond to the movable rail of a switch, as it is not fastened to the top side of the sleeper. In a top view, a cover zone (varying as it moves) corresponds to it. Nevertheless, a through-opening is preferably also provided for such movable rails such that tamping can be satisfactorily performed also along the section under the switch.

The sleeper body is preferably symmetrical such that its axis of symmetry is parallel to the straight rails to be laid—running perpendicular to the sleeper—and is at an equal distance from them. Arranging the through-openings in a row also involves that they are arranged symmetrically with respect to this axis of symmetry. This arrangement in a row is also applicable for the side of the sleeper that lies transversely to the rail laying band region, if it has a straight or indented straight shape.

In the foregoing, the entire through-opening was described in relation to the intended rail laying band region and to the intended seating regions. By that it is meant that, seen in a top plan view (i.e. vertically projecting the rail laying band region) the through-opening in its entirety is situated between the adjacent seating regions and extends farther than the intended rail laying band region, i.e. not only the opening end thereof situated at the top side of the sleeper body, but also the second opening end thereof which is formed at the second side thereof (see the top view of FIG. 2). In addition to the present embodiment, these features appears also in the other illustrated embodiments. In contrast to the present one, in other illustrated embodiments there are included more than one adjacent seating regions per rail laying band region on a sleeper, with a respective through-opening being arranged between adjacent ones (see FIGS. 6A-7). With sleepers having a raster allocation other than a raster allocation of two, an oblique rail placement is only allowed to a lesser extent, so the intended rail laying band region becomes narrower.

The lateral wall (side wall) of the through-opening can therefore be perpendicular to the top and bottom sides, or has a maximally low angle of inclination with respect to them (see below, for example the amount of inclination is lower than e.g. 1:10). As illustrated in the figures, the lateral wall of the through-opening can be constituted by flat faces (in this case the shape of the cross section of the opening is rectangular or rectangle-like as seen from above), but such through-openings can also be conceived that have ellipsoidal or other distorted-circular cross sections as seen in a top plan view of the sleeper. The inclination of the lateral wall can also be interpreted in this case, and it preferably falls between the specified limits (i.e. between vertical and the maximum inclination).

As with the known approaches, the rail laying band regions extend on the top side of the sleeper in the direction of the rail to be fastened. In the case of a known simple (single) sleeper, the rail laying direction is precisely the direction perpendicular to the longitudinal direction of the sleeper; with such a conventional sleeper the rail laying band region extends entirely along the top side of the sleeper. In the invention, the rail laying band region is positioned in a fashion similar to the known approaches, but in the case of the invention the rail laying band region passes also above the through-opening. The rail laying band region can also be called a rail laying region or rail laying surface band (zone).

According to the invention, the rail laying band regions can have a common through-opening or the regions can have respective mutually separate through-openings. In the case of a general sleeper located at a typical track section (i.e. at a straight or curved section without a switch), due to the larger support surface area it is generally expedient to form a separate through-opening for each rail laying band region.

However, a switch for example has a rail that is situated between the two fixed rail portions, and is sideways movable to some extent; a separate through-opening can be preferably arranged corresponding to this rail portion, preferably arranged in the same line with the through-openings corresponding to the encompassing rails. At such portions of the movable rail that cannot be displaced too far from the fixed rail, a through-opening connected with the through-opening corresponding to the fixed rail can be arranged to correspond to the movable rail (i.e. this through-opening has a greater lateral dimension than the through-opening applied in the general-purpose sleeper, which involves that this special location of the through-opening affects the dimensioning thereof). Also, such a sleeper can be preferably applied for any portion of the movable rail (and also for other track sections) that comprises a common, connected through-opening corresponding to the two stock rails and also to the movable rail between them.

Furthermore, near railroad switches such sleepers are customarily applied which extend under both parallel tracks connected by the switches. In relation to the sleeper according to the invention this means that such a (long) sleeper can be conceived that extends under two adjacent pair of rails, and through-openings corresponding to all of the individual rails being formed thereon. The portion of the rails of the switch that is situated between the two parallel pair of rails is also supported on a sleeper extending under both tracks; through-openings can also be arranged under the rails along this portion. The turnout can further comprise, at the crossing (at the point where the curved rail of the diverging branch of the turnout—of which the end extends for example as far as the left rail—crosses the other rail, which in this case is the right-hand-side rail), such a sleeper that has three separate through-openings corresponding to the fixed first rail, to the crossing, and to the pair of the diverging rail, respectively. In this case, therefore, in addition to the two through-openings corresponding to the stock rails, the sleeper comprises another through-opening (and of course has a length that allows for accommodating them, cf. FIG. 8).

The case wherein a respective guard rail extends along the inner side of one or both "base" rails is also mentioned. In this case, a through-opening of such dimensions can be applied that extends transversely (preferably perpendicular) to the basic rail laying direction such that it also extends under the guard rail, i.e. the tamping machine can perform tamping at both sides of the unit formed by the rail and the guard rail. The guard rail therefore affects the dimensioning of the through-openings (i.e. essentially such dimensions are to be applied [see the description of FIG. 6B] according to which the rail, the guard rail and the gap between them are considered instead of a single rail, to the components a combined rail laying band region is assigned, the through-opening extends farther in both directions than it); in case a single common through-opening is applied, such considerations need not be made because the common through-opening extends under the guard rail.

Figure 5:
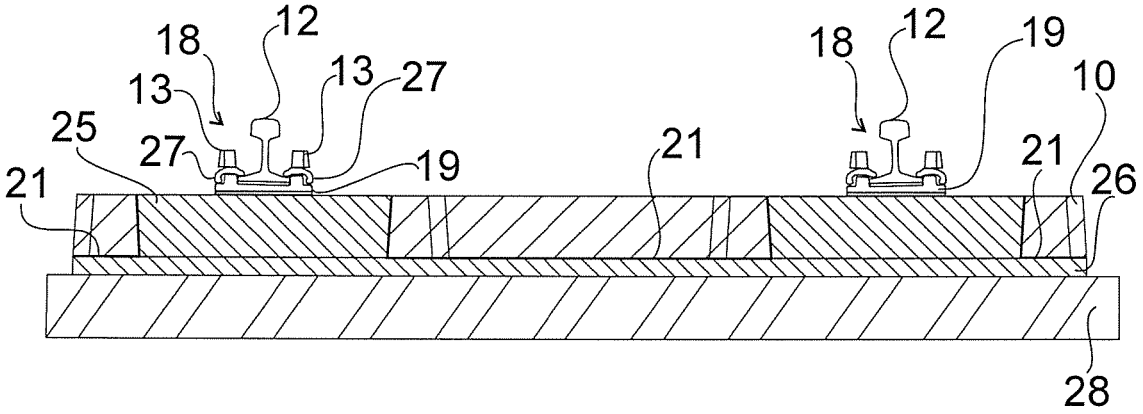
FIG. 5 illustrates in a cross-sectional drawing the embodiment of FIG. 1 cast with concrete.

Each rail of the rail pair applicable with the sleeper is laid in a respective rail laying band region applying a customary rail fastening. An exemplary rail fastening manner is shown in FIG. 5 (see below in detail). In FIG. 5 a simple dual-screw rail fastening is illustrated (fastening holes 33 and 63 corresponding thereto are also shown in FIGS. 6A-7). There also exist so-called "double" (four-screw) rail fastenings, wherein a typically larger zone corresponds to the rail fastening. This four-screw fastening still constitutes a single rail fastening; rail fastenings have to be located at certain intervals along the rails, a rail fastening—be of the four-screw or another type—are installed with appropriately dimensioned spacings from the next rail fastening configured this way. Accordingly, instead of referring to a connection of a single screw (of which typically more than one are included at a given rail fastening location), the term "rail fastening" refers to specific groups of fasteners, for example, two or four screws (the complete rail fastening arrangement corresponding to a given location) that, being arranged at certain intervals, define rail fastening locations. The seating regions (the regions at which the corresponding component of the rail fastening is seated when the assembly is fastened utilizing the appropriate number of screws, the portion situated inside the rail laying band region can be called a rail fastening part) can be specified for the various types of rail fastenings. The through-opening(s) of the sleeper body is (are) formed between the adjacent seating regions (for a given rail, the through-opening is arranged between the two adjacent seating regions of the corresponding rail laying band region).

As shown in FIG. 5, a fastening plate 19—providing a certain spacing between the rail and the surface under it where it is not seated against the plate—is arranged between the rail 12 and the surface under it. When the rail 12 is fastened, in the region occupied by the sleeper body 10 the rail 12 runs either above the through-opening 14, or above the portion of the rail laying band region situated on the sleeper body 10. Because the rail 12 is kept spaced apart from the sleeper by the fastening plate 19, it is not seated on the sleeper at the region above the sleeper body 10 but extends above it, being supported against the sleeper only in the seating region. The rail itself is not a component (part) of the sleeper according to the invention; rails of various different configurations can be applied with it.

Accordingly, typically two rail laying band regions are situated on the top side of a sleeper, each of which being adapted for connecting a respective rail (concerning sections with guard rails, turnouts or switches, etc. see above). The relative distance of the rails (i.e. the track gauge) is usually determined by regulations or standards; it tipically determines the distance between the rails and the centreline of the sleeper (along the basic rail laying direction, i.e. preferably the axis of symmetry thereof), and thus also the location of the intended rail laying band regions. The track gauge can of course vary in order to comply with the standards, or according to the chosen track type. The intended rail laying band regions are therefore such regions of the top side of the sleeper body that can be covered by or obscured by the rail, when seen from a top view (in case of the rail being laid straight or oblique, or of applying a curved rail; in the top drawing of FIG. 2 the basic rail laying band regions can be easily identified in the illustrated embodiment of the sleeper according to the invention, the "extension" thereof can be comprehended contemplating FIG. 8).

In FIGS. 1 and 2 showing the operating state completed with rails it can be seen that the through-openings 14 extend all the way under the corresponding rail 12 (which, although not a part of this invention, is shown in the figure in its state connected to the sleeper), and extends farther in both directions than the basic rail laying band region, i.e. in the figure the area covered by the rail (due to the position of the fastening holes corresponding to the rail fastenings, this is also the case in the embodiments of FIGS. 6A, 6B, and 7), and also extend over the typical intended rail laying band region (i.e. under the rails, if they are arranged oblique, or a curved rail is applied). The through-opening 14 therefore extends to both sides of the rail to such an extent that, applying crushed stone ballast, the tamper hammer can penetrate as far as the crushed stone ballast at both sides of the rail.

In an embodiment of the invention, a respective through-opening separated from each other corresponds to each intended rail laying band region, i.e. through-openings separated from each other are formed for each rail of the track corresponding to the sleeper.

In the illustrated embodiments of the invention, furthermore, a first opening end of the through-opening on the top side and a second opening end of the through-opening on the bottom side are arranged opposite each other. In addition to that, as it will be seen, the through-opening preferably shrinks uniformly from top to bottom (the bottom opening end is preferably a slightly shrunk copy of the top one; and, besides that, the shrinking is uniform, i.e. linear, the lateral walls can be e.g. determined by flat faces), the expediently chosen axis of the through-opening (about which axis the opening exhibits some kind of symmetry) is perpendicular to the—preferably flat—top side of the sleeper.

The sleeper according to the invention is therefore a sleeper wherein one or more through-openings adapted to interconnect the top and bottom sides are formed. The portions situated at both sides of the line connecting the pairs of through-openings or the common through-opening can also be interpreted as sleeper "branches". It can therefore be said that these sleeper branches are interconnected by the sleeper portion lying between the openings corresponding to the two rails, and by the frontal portion terminating the sleeper in a direction perpendicular to the rail. The one or more through-openings are in all cases encompassed by the material of the sleeper, being open expediently only at the first and second opening ends.

One of the most important characteristics of the above described sleepers (preferably, plate-type sleepers) is that—depending on the raster arrangement of the fastenings and the size of the sleeper—one or more openings (through-openings) are formed therein, each of which being arranged between two rail fastenings, along the path of the rails to be fastened. The through-opening can also be called an adjustment opening. Such openings allow the operation (reaching under the track) of the hammers of the tamping machine, in the regions between the sleepers, when the sleeper is laid in crushed stone ballast (first arrangement mode), much like it is possible in the case of conventional superstructures comprising crushed-stone ballast and sleepers. A possibility of tamping between the rail fastenings is provided, independent of that a single sleeper spans on ("covers") multiple rail fastenings (see also FIGS. 6A, 6B and 7).

By applying the same sleepers (preferably plate-type sleepers) laid on rigid foundation—as it has been touched upon above—the above mentioned through-opening (adjustment opening) has a different function.

In the sleeper according to the invention, the cross-sectional area of the through-opening increases on at least a section (on at least a part) from the bottom side towards the top side of the sleeper body. From the aspect of providing a rigid foundation (see the description of "plugging" below, which allows for making a shape-fit connection applying such a through-opening) this constitutes an advantage, but at the same time it does not have any disadvantages even if the same sleeper is to be laid on a crushed stone ballast. It is preferable to utilize such sleepers that are equally well suited for application with both types of foundation, because even in the case of the same track there can be engineering structures between the crushed-stone ballast sections, or other sections where it is expedient to apply a rigid foundation. If the sleeper can be utilized with both types of foundation, preferably only one type of sleeper has to be transported to the construction site (i.e. it is not necessary to transport there different sleepers).

In a further embodiment, the cross-section of the through-opening, being parallel to a plane corresponding to the bottom side (can be assigned to the bottom side), preferably increases uniformly (steadily, i.e. not only along a portion) from the bottom side towards the top side of the sleeper body. Furthermore, the through-opening has a rectangular or rectangle-like (nearly rectangular, for example with bevelled corners) cross-section parallel to a plane corresponding to the bottom side. It is also possible to implement the uniformly increasing cross-section of the through-opening by providing—in accordance with the oblong shape of the through-opening—a distorted circular, or other, preferably elongated cross-sectional shape.

In order to fulfil certain functions it is sufficient if the cross-sectional area increases along at least a portion, in which case the material filled into through-opening and setting therein forms a "plug" in the sleeper, i.e. the sleeper cannot be displaced upwards because the "plug" cannot be moved with respect to the foundation. It is also advantageous from the aspect of manufacturing if the through-opening has a uniformly increasing cross-sectional area, i.e. the one or more inclined walls of the through-opening have a uniform inclination. In the illustrated embodiment, all lateral walls of the through-opening (preferably also the bevelled corners) have the same inclination (this is also advantageous for formwork, i.e. for the removal from the formwork). Because too high an inclination can be problematic for tamping, expediently the inclination is not overly high. Depending on the thickness of the sleeper, the inclination can be for example between 1:20-1:10 (approximately 2.86° and 5.71° relative to the axis of the through-opening mentioned below), the inclination is to be interpreted between the axis (in general, an axis perpendicular to the preferably parallel top and bottom sides of the sleeper body) of the symmetrically configured, uniformly narrowing (the cross-sectional area increasing uniformly from the bottom side towards the top side) through-opening and the plane of the lateral wall. This range can preferably also be interpreted if not all of the walls are inclined, or the cross-sectional area increases only along a portion of the through-opening, then, only for a given portion of a particular lateral wall. The dimensioning of the through-opening allowing for the operation of tamper hammers is also suited for this type of installation, i.e. by injecting concrete.

In an embodiment, therefore, lateral walls of the through-opening interconnecting the top side and the bottom side are determined (defined) by flat lateral wall portions, the through-opening has an opening axis perpendicular to the top side, and the inclination of the flat lateral wall portions relative to the opening axis is between 1:20 and 1:10.

To put it in a slightly different way, the through-opening preferably expands from bottom to top (i.e. in a built-in state, from the base towards the rail). Thus, by injecting an appropriate material into the spatial region under the plate-type sleepers and into the opening(s), a shape-fit fastening of the sleeper is produced that adequately secures it in the longitudinal and transverse directions of the track, and also adequately prevents vertical displacement, so it is especially well suited for assuming dynamic loads caused by moving railway vehicles.

In light of the above, regarding the approach disclosed in KR 20160001011 U mentioned in the introduction the following can be mentioned. Although in the approach disclosed in the document such a through-opening can be arranged in an embodiment that extends farther than the rails in both directions (this can be seen for example in FIG. 5 of the document), this known approach has a number of drawbacks.

The most important of these drawbacks is that in the known approach there is not formed a through-opening with a cross-sectional area increasing along at least a section of the opening, from the bottom side of the sleeper towards the top side thereof. The above-mentioned FIG. 5 of the prior art document comprises two drawings. In the top drawing there is shown the known sleeper in top view, while the bottom drawing of FIG. 5 illustrates a cross section wherein the outline of the through-opening is indicated (the portion marked with a reference numeral 160 of the through-opening). As indicated by this outline, in contrast to the invention, in the prior art approach the through-opening continuously narrows towards the top side, i.e. it has no expanding portion. Accordingly, the "plugging" effect cannot be achieved applying this prior art approach.

There was not found any advice for a through-opening with a cross-sectional area increasing from the bottom side towards the top side of the sleeper on at least a section (like the through-opening according to the invention) either in KR 20160001011 U or in any other earlier document. In relation to that it is important to note that through-openings that differ in this aspect can be manufactured applying different types of formwork, so the configuration of the appropriate through-openings requires different manufacturing considerations (for example for "pulling off" the completed product from the formwork).

In KR 20160001011 U, a sleeper with a complex shape is illustrated (for example, with different emphasized shaped protrusions along the sides, and with a separate protruding portion for receiving the rails). In contrast to that, the sleeper body of the sleeper according to the invention is preferably a concrete plate, wherein openings are formed (preferably by providing a formwork), and of which the edges are shaped appropriately (the edges are basically straight, with typically the corners being cut off (bevelled), and with a lateral indent being preferably formed in each side lying transversely to the intended rail laying band region), however, preferably there are not made any protrusions or recesses either on the top or the bottom side of the bulk of the material thereof, so—of course disregarding the through-openings—it has a flat top side and a flat bottom side.

The sleeper according to the invention is therefore preferably shaped by the proper shaping of the sheet (i.e. the sleeper body is formed from a sheet), by which it is meant that during manufacturing proper formwork is provided for the edges of the sheet and the through-openings, but inside the formwork the sleeper is formed to have a flat sheet shape.

In contrast to the approach disclosed in KR 20160001011 U, according to the invention a reinforcement protruding from bottom side of the sleeper is preferably not applied. The reinforcement preferably applied in the sleeper according to the invention is configured such that the reinforcing components are arranged inside the sleeper (entirely, i.e. they do not protrude anywhere from the sleeper).

FIG. 1 is a drawing showing a view of an embodiment of the sleeper according to the invention. The embodiment of FIG. 1 is a sleeper (preferably a plate-type sleeper) with a raster allocation of two, the sleeper according to the invention is generally a sleeper having a raster allocation of at least a two.

In FIG. 1 there are rails 12 attached to the sleeper body 10 of the sleeper. The rails 12 are not part of the sleeper according to the invention, however, for easier comprehension they are shown in some of the figures. In some figures wherein the rails are not shown, there are shown so-called fastening holes that are adapted for fastening or receiving components of the rail fastenings (for example, screws), and for example have counter-threading for the screw. These fastening holes are also not necessarily part of the sleeper according to the invention; they can be made in advance, but can also be prepared on-site for rail fastening.

In FIG. 1, therefore, a perspective view of the installed state of the sleeper body 10 (preferably of a plate-type sleeper), the rails 12, and the rail fastenings 18 (shown schematically) is shown. The illustrated arrangement is typically a schematic view of a crushed stone-ballast solution, intending to show the arrangement of a single sleeper (preferably a plate-type sleeper) relative to the rails (the crushed stone ballast is not shown).

In FIG. 1, certain further details of the embodiment comprising a separate through-opening 14 for each of the rails can be observed. FIG. 1 illustrates that the through-openings 14 are formed underneath the rails 12, i.e. they are configured to extend farther than the rail laying band region between the two rail fastening locations (and thus between the seating regions corresponding to the rail laying band region). The rail 12 cuts the through-opening 14 in two essentially equal halves, i.e. it runs above it essentially in the middle.

By arranging and dimensioning the through-openings 14 according to the invention, the operability of the adjustment hammers (tamper hammers) can be preferably ensured. The arrangement of the through-openings 14 essentially allows that the rail section between the two rail fastenings 18 can function as a free rail section as far as the adjustment hammers are concerned. The operation of the tamper hammers is therefore not affected by the fact that the through-openings 14 are fully encompassed by the sleeper body 10. At the same time, thanks to the configuration according to FIG. 1, the sleeper body 10 has a front side (or front face) with a large surface area, with the area of the bottom support surface of the sleeper also being relatively large, because the openings extend in the direction of the central portion of the sleeper to a relatively limited extent (for more details see the discussion of FIG. 6B below). In an embodiment, therefore, the sleeper body has a continuous lateral wall extending parallel to the direction of the intended rail laying band region, interconnecting the top side and bottom side thereof, and having a length along the intended rail laying band region being equal to or larger than the distance between the centres of the adjacent intended seating regions (this is the side that terminates the through-opening in a direction transverse to the rail laying band region, i.e. a lateral wall with respect to the rail laying band region), that is the front side of the sleeper body parallel to the rail is continuous at least along the portion between the centres, and consequently the front side is large. Thereby, by the help of the largest possible front side, the movable crushed stone mass can be expediently increased relative to the known approaches.

As illustrated in FIG. 1, in this embodiment the rails 12 can be fastened to the top side 15 of the sleeper body 10. To achieve this, in the present embodiment a rail fastening 18 is applied, one per each rail fastening location (i.e. per each seating region of the rail laying band regions). In FIG. 1 the fastening plates 19 utilized for the rail fastenings 18 are also shown. The depicted rail fastening 18 is implemented applying two screws, but other types of rail fastening (for example, having more screws) can also be applied. The seating region of the top side of the sleeper body that corresponds to the rail fastening can be determined in all cases.

In relation to the rail fastenings see also FIG. 5. In FIG. 1 the configuration of the through-opening 14 applied in this embodiment can also be clearly seen (the shape of the through-opening 14 can be clearly seen in a top view in FIG. 2, too). Accordingly, taken relative to its (through) axis perpendicular to the top side, the through-opening 14 has a rectangular cross-sectional shape with the corners of the rectangle being cut off (thus the shape of the cross section is octagonal; it can also be called "rectangle-like", see also below). In FIG. 1 there is shown a first flat lateral wall portion 16 of the through-opening 14, as well as a second flat lateral wall portion 17 situated at the other side of the rectangle-like cross section. At the edges of the lateral wall portion 16 there are first wall bend lines 22, with second wall bend lines 24 being arranged at the edges of the lateral wall portion 17. The wall bend lines 22, 24 have the same inclination as the lateral wall portions 16, 17 (see below for more details). The portions between the wall bend lines 22 and 24 preferably lie at the same angle with respect to the corresponding lateral wall portions 16 and 17 (this angle is about 135° because the lateral wall portions 16 and 17 have a relatively low inclination), but the corners can be cut off at another angle, or even along a non-straight line ("rounding", these alternatives are encompassed by the concept of rectangle-like cross-sectional shape: the shape is essentially rectangle-like).

Bevelling of the inner (negative) corners of the through-openings is also aimed at mechanical protection, because stress cracks may start from the (sharp) corners, which can lead to the failure (cracking) or the sleeper. This can be achieved by rounding off the corners at a radius of R=1-5 cm, or by applying a flat 45° bevel which may have a length of 2-4 cm (this latter is illustrated in FIGS. 1 and 2). The through-opening has to be dimensioned, and also the parameters of the tamping machine have to be chosen such that this corner is not broken off. As far as the through-openings are concerned, the rounded/cut-off corners are more preferable than a fully rectangular cross section.

As it is illustrated in FIG. 1, lateral indents 20 are preferably arranged along the lateral walls of the sleeper body 10 that extend along a direction transverse to the rail laying band region. These preferably extend along one-third to one-fourth of the length of the lateral wall 23, and can be implemented to be interconnected or separate (multiple shorter indentations). As shown in FIG. 1, in this embodiment the corners at the edges of the lateral walls 23 are preferably also cut off. In FIGS. 6A, 6B and 7 below such embodiments are also shown wherein the corners of the lateral walls are not cut off; however, lateral indents and cut-off corners can of course be included in those embodiments.

The lateral indents 20 that are shown in FIG. 1 have a typical depth of 3-4 cm. Lateral indents with greater depth would be in the way of optionally applied reinforcements, stressing wire, and would unnecessarily decrease the cross sectional area (taken parallel to the rails) of the sleeper, so the application of deeper lateral indents would not be advantageous. Rounding off the corners of the sleeper is also advantageous for installation and during operation: it is expedient to avoid having "positive" corners in concrete components, as they can break off easily and would cause potential failure points. It is also advantageous from the aspect of movement in and mechanical resistance to the stone ballast.

In FIG. 2, the embodiment illustrated in FIG. 1 is shown in top view, showing multiple sleepers. FIG. 2 illustrates the arrangement of three sleeper bodies 10 along a section of rails 12. The illustrated embodiment has a raster allocation of two, by which it is meant that two seating regions are formed on the sleeper for each rail laying band region. FIG. 2 is, therefore, the top drawing of a track section made utilizing three sleepers (preferably, plate-type sleepers) with a raster allocation of two, showing a stylized view of the rails, but not showing the rail fastenings. FIG. 2 can be used to illustrate the raster allocation of the sleeper bodies 10, and their relationship in the horizontal direction. In FIG. 2 there can be clearly seen the regularly alternating arrangement of the through-openings 14 (through-cuts), adapted for example to function as adjustment openings, and the gaps between the adjacent sleeper bodies 10, which allows for a continuous motion of the tamping machine during operation. Therefore, as shown in FIG. 2, the through-openings 14 and the gaps between the sleeper bodies 10 are arranged alternately along the rails 12, the centre of each gap being situated right in the middle between the centres of two adjacent through-openings 14. In FIG. 2 the rail fastenings are not shown.

Figure 3:
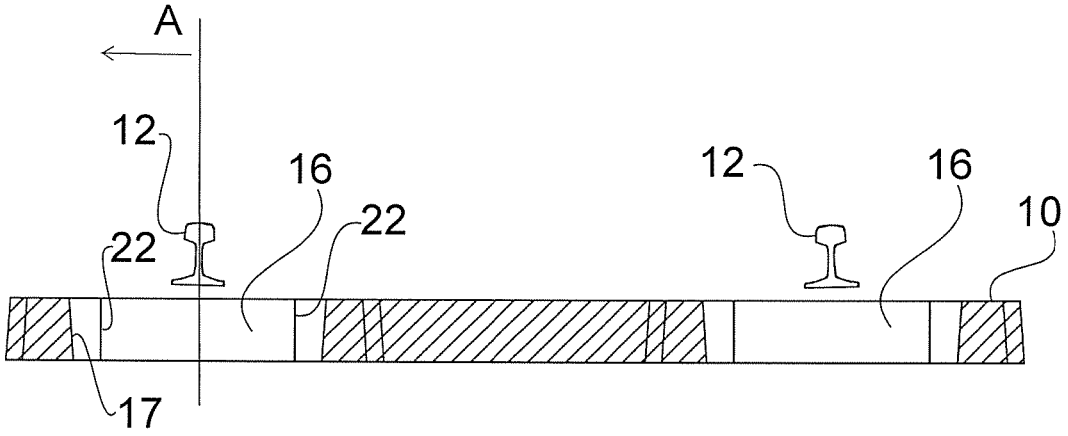
FIG. 3 is a longitudinal sectional drawing of the embodiment of FIG. 1.

In FIG. 3, the sleeper body 10 that is also illustrated in FIGS. 1 and 2 and has a homogeneous cross section as far as its main profile is concerned (its thickness does not change, and its width only changes to a small extent due to the arrangement of the lateral indents 20) is shown in a sectional drawing. In FIG. 3 the sleeper body 10 is depicted cut along its longitudinal (i.e. crossing the through-openings corresponding to both rails in the embodiment of FIGS. 1 and 2) axis of symmetry.

In FIG. 3 the rail fastenings 18 are not shown, while the rails 12 are shown in a stylized manner, with the sole purpose of indicating their typical position. The regions indicated by diagonal hatching in FIG. 3 show the cut-away material of the sleeper, while the non-hatched regions between them correspond to the multi-functional (adjusting, casting, anchoring) through-openings 14 formed in the gaps of the grid. As illustrated in FIG. 3, the lateral wall portions 17 of the through-openings 14 are not vertical, but are adapted to shrink from top to bottom and thereby form the through-openings 14 having a smaller cross-sectional area at the bottom, and a greater one at the top. In accordance with the sectional view, in FIG. 3 there can be seen the wall bend lines 22 of the lateral wall portion 16. In the installed position of the sleeper, the through-openings 14 receive the material of the crushed stone ballast, or the cast anchor pin adapted for providing attachment to the base layer (for more details on the latter see FIG. 5), depending on the track system to be built.

Figure 4:
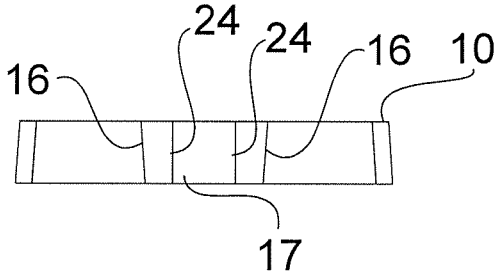
FIG. 4 is a section taken along plane A shown in FIG. 3.

The plane along which section A marked in FIG. 3 is taken to cross the longitudinal axis of the rail 12 that can be arranged on the left of the figure, i.e. at the centre of the left-side through-opening 14 in the figure. As indicated in FIG. 3, section A faces outward, i.e. towards the edge of the sleeper body 10. Accordingly, the symmetrical configuration of a sleeper body 10 having a raster allocation of two can be observed in section A shown in FIG. 4. In FIG. 4, therefore a cross-sectional view of the sleeper taken along the longitudinal axis of the rails 12 is shown that can be arranged on the sleeper; the rails 12 themselves are not shown in FIG. 4. The cross-sectional configuration of the through-opening 14 can also be seen in FIG. 4, according to which—as with the lateral wall portions 17 shown in FIG. 3—the lateral wall portions 16 are not vertical but have a configuration that narrows downwards. In accordance with the sectional view, in FIG. 4 the wall bend lines 24 are observable.

In FIG. 5 a longitudinal section of a variant with rigid foundation is shown (it corresponds to the section shown in FIG. 3; in the embodiment of FIG. 1, for example, a resilient layer and rigid foundation are applied, i.e. for example it is cast with concrete), which can also be interpreted from the aspect of the sleeper body 10 as a section crossing the centreline of the view illustrated in FIG. 4, but an interpretation of the view on longer sleepers (see the second and third sleeper bodies 30, 60 shown in FIGS. 6A, 6B and 7) is also possible. In FIG. 5 cast portions 25 (preferably of concrete) that fill up the through-openings 14 and function as pins are shown. The manner of arranging the rails 12 symmetrically to their centreline at the portions corresponding to the through-openings 14 can also be observed in the figure. In FIG. 5 an exemplary mode of rail fastening is also shown: according to FIG. 5, in a conventional manner the rails 12 run on the fastening plates 19 against each of which a respective washer 27 is pushed by attachment screws 13, the washers 27 being adapted for pressing down also the bottom edge of the rail 12.

In FIG. 5 it is shown that an intermediate layer 26 is arranged under the cast portions 25. A base layer 28 that supports the structure (i.e. constitutes an adequate substructure) is situated under the intermediate layer 26. The material of the intermediate layer 26 is expediently the same as the material of the cast portions 25, i.e. for example concrete. If concrete is applied, the base layer 28 is prepared first, for example by injecting the material under the sleeper through injection openings 35 and 65 shown in FIGS. 6A and 7. In a subsequent manufacturing phase the cast portions 25 are produced. Because in this case both are made of concrete, when set, to a certain (satisfactory) extent the cast portions 25 and the intermediate layer 26 form a single component. The dividing line between these two components shown in FIG. 5 therefore indicates only that they are made in two separate manufacturing steps. There is a friction action occurring between the intermediate layer and the base layer 28 situated underneath it, typically their mutual displacement is prevented by friction.

In a "floating" structure utilized for increasing track service life and for reducing noise and vibration, a resilient layer 21 can be arranged on the sleepers (so in the sleeper body 10, 30 and 60, too) at locations in contact with portions cast with concrete, for example applying a suitable elastomer sheet. This resilient layer 21 can also be included in the configuration with a crushed stone ballast, and can function as a vibration damper layer protecting the ballast. In this case the cast portions 25 are replaced by crushed stone material that allows for performing the tamping operation. In an embodiment, therefore, a resilient layer is arranged on the bottom side of the sleeper body and/or on a lateral wall of the through-opening interconnecting the top side and the bottom side of the sleeper body. In the illustrated embodiment a resilient layer is arranged at the bottom side and also at the lateral wall of the through-opening, but in other conceivable variants it is arranged at only one of them.

Therefore, FIG. 5 shows a cross-sectional view of a track arrangement applying rigid foundation and "floating" (coated with resilient sheet material) plate-type sleepers, taken along the plane of the (adjusting) through-openings formed between the rail fastenings, showing the base layer, the resilient elastomer sheet (resilient layer), the rails and the rail fastenings in a stylized manner. In FIGS. 3 and 5 there can be seen lines representing the lateral indent 20, as well as lines illustrating the cut-off outer corners of the sleeper body 10 in FIGS. 3-5.

In FIGS. 6A and 6B, the top view of a second sleeper body 30 having a raster allocation of four and second through-openings 34 is shown (in FIG. 6A the major components are indicated, while FIG. 6B shows the distances). Like the sleepers shown in other figures, the sleepers shown in FIGS. 6A-6B and FIG. 7 can be termed plate-type sleepers, i.e. sleepers with a flat configuration. In relation to FIG. 6B the raster allocation is described, the description is applicable to embodiments shown in other figures. The raster allocation is the distance between the rail fastenings typically indicated by fastening holes 33 along the rail. In this example, a pair of fastening holes 33 belong to each rail fastening, the distance between adjacent pairs is the raster allocation, i.e. a distance 44 in FIG. 6B. This distance—which is the distance between adjacent pairs of fastening holes defining the centreline of rail fastening locations, i.e. is typically also related to the distance between the seating regions—is preferably between 50 and 100 cm, and particularly preferably varies between 60 and 75 cm depending on railway operation regulations. Of these rail fastening locations (and seating regions) at least two are located on each sleeper according to the invention, so, because the distance between the rail fastenings is limited by applicable standards, the width of the sleeper according to the invention far exceeds that of the widely applied sleepers.

In FIG. 6B a number of distance data characteristic of this embodiment are indicated. The configuration of the sleeper can be defined applying these distance data; based on the indicated distances, these data can be derived in the case of sleepers with other raster allocation, i.e. having fewer or more rail fastening locations and seating regions. In an example, a width of the sleeper body portion under the rail fastening, marked by a distance 58, is 30 cm (optionally, based on certain special operator requirements it can be varied between 20-50 cm). The sleeper body 30 has a second side length 42 measured along the basic rail laying direction (that is, the longitudinal direction of the rails), and a first side length 40 measured in a direction transverse to the rails to be laid (the mode of fastening the rails to the sleeper can be established from the position of the fastening holes 33).

The longitudinal dimension of the sleeper body 30 (side length 42) can be obtained by multiplying a first distance 44, corresponding to the distance between the rail fastenings arranged along a rail axis 50 (the axis of symmetry of the rail), by the number of raster allocations (the number of gaps between the rail fastenings, in this example, three) and adding thereto the value of distance 58. Therefore, in FIG. 6B the following holds true: 3×(distance 44)+(distance 58)=(side length 42). The side length 40 (the width dimension of the sleeper body 30) is typically between 240 and 270 cm, the typical thickness is 15 cm, but the width can vary between 10-30 cm depending on railway regulations and standards (it can be affected by axle load, velocity, or other geometrical constraints).

An extension 56 of the through-opening 34 measured along the longitudinal direction of the rail laying band region, i.e. parallel to the rail (the shorter side or second dimension of the through-opening that has an oblong shape when viewed from above, second inner size) is obtained by subtracting the distance 58 from the distance 44, or in other words, it is obtained as the raster allocation minus the distance 58, so typically (distance 44)−(distance 58)=(extension 56), which can therefore be between 75 cm−30 cm=45 cm, and 60 cm−30 cm=30 cm taking into account the above given values, but the value can optionally also fall outside this interval. The extension 56 is preferably between 20 and 80 cm (the upper limit can also be 65 cm), particularly preferably between 30 and 45 cm (the lower and upper limit values can be combined as desired). With these values, an appropriately large front side is obtained at the side of the sleeper body parallel to the rail. From these values it can also be inferred that by setting the distance 58 (i.e. the width corresponding to a branch of the sleeper) to 30 cm according to the above, the width of the raster allocation of two variant (measured along the longitudinal direction of the rail laying band region) will be between 90 and 115 cm, that is, the two adjacent rail fastening locations (and the respective seating regions on the rail laying band regions) are arranged on this width in case two of them are situated on the given sleeper body (as in the embodiment of FIGS. 1 and 2). The other exemplary values (particularly the dimensions of the through-opening and the dimensions measured transverse to the longitudinal direction of the rail laying band region) can be applied according to the example below also to the example having raster allocation of two.

Consequently, there may be such a case wherein the distance 58 is different from the extension 56 (measured parallel to the rail), i.e. the portions (branches) of the sleeper situated around the through-opening 34 along the rail are narrower than the dimension of the through-opening 34 measured along the rail. In FIGS. 6A, 6B and 7 these two dimensions are essentially identical, as well as the corresponding dimensions in the embodiment of FIGS. 1 and 2. If the sleeper is wider than the corresponding branch of the sleeper, then for example in the arrangement according to FIG. 2 the sleepers can be placed at a greater mutual distance, i.e. in order to arrange the rail fastenings at equal intervals, at a distance corresponding to the width of the through-opening measured along the rail.

In line with the above data, in an embodiment the largest extension of the second opening ends of the through-openings on the bottom side in the direction of the intended rail laying band region is 50-60% (more generally, these limits are 45% and 65%) of the distance between the centres of the adjacent intended seating regions (if the seating region is defined by a rectangular fastening plate, the distance is measured from its centre, while for example in the case of the fastening being implemented utilizing two screws the centres of the rail fastening portions and typically the centres of the seating regions are coincident with a point situated between the two screw holes at an equal distance from both). The above is of course applicable to the illustrated sleeper type that has a(n essentially) rectangular shape when seen from above. In the case of the known approaches this percentage is very high, way higher than the above specified percentage limits, i.e. therein the surface area taken by the opening from the useful support surface area of the sleeper is much larger. This condition is preferably fulfilled also in the case of the embodiments of FIGS. 10-12.

In FIG. 6B there is also shown an extension 54 or dimension of the through-opening 34 measured transverse to the rail laying band region (the longer side or first inside dimension of the through-opening having an oblong shape when seen from above, first inner size). In the illustrated embodiments the through-opening has a symmetrical configuration with respect to the rail axis 50 (i.e. the rail is arranged above the centreline of the through-opening), that is, in this embodiment the rail axis 50 intersects the through-opening 34 at the midpoint of the section corresponding to the extension 54 (besides that, as can be observed in FIG. 6B, the rail axis 50 lies at a distance 48 from the centreline of the sleeper body 30 that is parallel to the rails). Taking into account the base width (the greatest width measured at the base of the rail) of the typically applicable standard rails (typically 120-150 mm), and also the typical dimensions of the hammers of a tamping machine, as well as the work safety gaps from the rail base that are produced when introducing the hammers, in an example applying a plate-type sleeper having a width dimension (first side length 40) of 240 cm, the extension 54 of the through-opening 34 (through-cut) measured transverse to the rail can be between 50 and 65 cm. As a result of that, a second distance 46 also indicated in FIG. 6B (i.e. the inside width or spacing between the through-openings 34) is for example between 86 cm (with a through-opening having a width of 65 cm) and 100 cm (with a through-opening with a width of 50 cm), and a fourth distance 52 (the dimension of the portion of the sleeper body that lies outward with respect to the through-opening) at the edge of the sleeper body 30 (at the outer side of the through-opening 34) can e.g. be typically between 12 cm (with a through-opening with a width of 65 cm) and 20 cm (with a through-opening with a width of 50 cm).

In another example, the side length 40 value is, to a good approximation, 260 cm, in which case the characteristic dimensions for a wider rail (having for example a greatest rail width of 150 mm) are: the extension 54 of the through-opening 34 measured transverse to the rail laying band region is for example between 65-88 cm (these larger dimensions are applicable for the smaller sleeper width above, with the opening dimensions of the lower-width sleeper being applicable for this wider sleeper; the extension of the through-opening measured transverse to the rail is therefore e.g. between 50 and 88 cm), the distance 46 (the width of the inner portion of the sleeper body 30) between the two through-openings 34 can for example typically be between 62 cm (with a through-opening with a width of 88 cm) and 84 cm (with a through-opening with a width of 65 cm), and the distance 52 beside the through-opening 34 being can be between 11 cm (with a through-opening with a width of 88 cm) and 23 cm (with a through-opening with a width of 65 cm). The dimensions of the extensions 54 and 56 characteristic of the through-opening can of course be applied for a variant with a different raster allocation (for example, two or other).

In an embodiment of the invention, a separate through-opening is arranged corresponding to each rail laying band region, i.e. through-openings separated from each other are formed for each rail of the rail pair corresponding to the sleeper. Besides that, preferably lateral farther-extensions of the through-openings (the through-openings, i.e. preferably the first and second opening ends thereof) from the intended rail laying band region are symmetrical with respect to the intended rail laying band region.

In an embodiment of the invention comprising a respective separate through-opening for each rail laying band region, therefore, in the case of attaching a rail, the through-openings are formed in a row extending in a transverse direction to the intended rail laying band region, the cross-section of the through-openings being parallel to a plane corresponding to the bottom side (and preferably also parallel to the top side; the plane corresponding to the bottom side is the plane which can be fitted to the bottom side, this plane coincides with the plane on which the sleeper can be placed) has a rectangular or rectangle-like shape, and the sum of the largest extensions (see the extension 54 above) of the second opening ends of the through-openings formed in a row on the bottom side in the transverse direction with respect to the intended rail laying band region is 40-70% of the extension of the sleeper body measured transversely with respect to the intended rail laying band region.

For the above cited exemplary values in particular, with a sleeper having a width of 240 cm, this percentage is approximately between 41.6% and 54.16% (for this case the limit values can preferably be 40% and 55%). For the sleeper with a width of 260 cm, this value can be approximately between 50 and 67.69% (the limits can for example be 50 and 70%, the ratios corresponding to the lower and upper limits of the two dimensions can be combined arbitrarily), i.e. taking into account the through-openings corresponding to both rails. For measuring the extension, the second opening end of the through-opening is taken into account, because they open to the bottom side supported against the foundation; so the dimensions characteristic thereof are indicated in FIG. 6B. In FIGS. 6A, 6B and 7 the double outlines of the second and third through-openings 34, 64 illustrate the inclination (lean) of the lateral walls, the inside outline corresponding to the narrower second opening end, and the outside one to the first opening end. The above condition, specifying the range of 40-70%, is preferably also valid for the embodiments of FIGS. 10-12.

In line with these values, in this embodiment the support surface of the sleeper is relatively large. In the known approaches the opening has a very large width relative to the portion not affected by the openings (i.e. the percentage ratio is disadvantageously much higher than in this embodiment), so the support surface is small. With other known approaches, the support surface is small because the portion interconnecting the sleepers has a low cross-sectional area (a low surface area contacting the support surface).

The tamper hammers can be situated (in a stationary state) approximately 5-10 cm, preferably 5-8 cm from the edges of the foot of the rail, and on the other side, from the edge of the through-opening, because they can also move laterally during tamping. It is expedient to keep the hammers spaced apart by a few centimetres also from the side of the through-opening lying perpendicular to the rail (this dimension of this side can be adjusted). To provide for that, it is preferable if the through-opening has the essentially rectangular (rectangular or bevelled-corner rectangular [rectangle-like]) cross-sectional shape (as seen from above) illustrated in relation to the described embodiments. The hammers have to be taken into account having a width, measured transverse to the rail laying band region (perpendicular to the rail) at both sides of the rail to be laid, of 100 mm, 140 mm, or 2×100 mm (so 200 mm in total, and if that is too wide, one can be folded out and utilized later on as a hammer with a width of 100 mm). the dimension of the hammers measured transverse to the rail laying band region therefore preferably falls between 100 and 200 mm. Such hammers can be utilized with sleepers having the above specified exemplary dimensions of the through-opening.

Like the above described embodiment, the embodiment according to FIGS. 6A, 6B and 7 also allows for the construction of both crushed stone-ballast and rigid-foundation track systems. In FIGS. 6A and 6B the rails and rail fastenings are not shown. The fastening holes 33 adapted for receiving rail fastenings (these can even be the dowels themselves that are inserted in the openings) are shown only schematically. In FIG. 6A there is shown an injection opening 35, and also the stylized positions of the lifting links 37 (threaded sleeves), but the rails and the rail fastenings are not shown (FIG. 7 depicts similar details but shows more injection openings).

In the case of the rigid-foundation implementation of larger-sized plate-type sleepers (such as the variants having the sleeper body 30 and 60 in FIGS. 6A, 6B and 7) a number of technologies can be applied for making the connections between the base layer situated under the superstructure that contains the sleeper (see the base layer 28 in FIG. 5) and the sleeper bodies 30, 60 (as illustrated in FIG. 5, this is also provided by a concrete layer, for example in FIG. 5, an intermediate layer 26 made of concrete), and for producing the cast portion 25, for example the so-called suspension technology, which has become widespread in other fields of railway construction industry.

Lifting links 37 shown in FIG. 6A and lifting links 67 shown in FIG. 7 are equally suited for receiving threaded screw stems adapted for making height adjustments (i.e. for levelling the horizontal components at an appropriate height above the base layer) also when the larger sleeper bodies 30, 60 are applied. In certain embodiments, therefore, lifting links adapted for receiving levelling screws are connected to the top side of the sleeper body. As also illustrated in the figures, the lifting links are preferably situated near the—optionally even bevelled or cut-off—corners of the sleeper, nearer to the lateral side of the sleeper (facing in a lateral direction with respect to the rail laying band regions) than the through-openings and the seating regions, as close as possible to the edge of the sleeper body both in a direction perpendicular to the rail (the rail laying band region) and in a direction parallel therewith.

After making the necessary height/level adjustments, injection utilizing runny concrete or other appropriate material, depending on the elaborated technology, is performed (typically, concrete is applied, but other materials can also be injected to fill up the intermediate layer). With injection technologies, in order to circumvent spreading-related problems arising due to the larger bottom surface area of the larger sleepers (such as, for example, sleepers with the sleeper body 30 and 60) it can be advantageous to prepare one or more injection openings (inner injection locations) 35 and 65. In an embodiment, therefore, an injection opening interconnecting the top side and the bottom side of the sleeper body is formed in the sleeper body separately from the through-opening.

The injection opening is adapted to allow for inserting a suitable material, preferably concrete, into the layer situated under the sleeper. Accordingly, one or more injection openings—separately from the through-opening—are formed for this purpose. Besides that, the one or more injection openings can be formed anywhere in the sleeper body, however, it can be expedient to arrange the one or more injection openings at a central portion of the sleeper body, such that the material injected therethrough can spread evenly under the sleeper body. Therefore, an injection opening can be preferably arranged in the geometrical centre of the sleeper body. According to FIGS. 6A and 7, the one or more injection openings are arranged along the centreline of the sleeper body that extends parallel to the rail (the geometrical centre typically falls on this line). The injection opening(s) and lifting links can of course also be arranged in the variant with a raster allocation of two (the embodiment of FIGS. 1 and 2).

In the embodiments of FIGS. 6A, 6B and 7, furthermore, three or more intended seating regions, each being applicable for a respective rail fastening, are arranged corresponding to each intended rail laying band region overlapping therewith (in the embodiment of FIGS. 6A, 6B, four for each rail, and in the embodiment of FIG. 7, six for each rail; these are arranged in pairs with the fastenings corresponding to the other rail).

In FIG. 7 a sleeper having sleeper body 60 with a raster allocation of six (i.e. having six rail fastening locations per rail) is shown in top view. In the figure, a possible arrangement of fastening holes 63 (and the dowels inside them), lifting links 67, and injection openings 65 (intermediate injection locations) is shown (lifting links 67 at the four corners and in the centre, and injection openings 65 near the centre), these features are not necessarily included in the sleeper according to the invention.

In the system comprising the sleepers according to the invention components with other raster allocation, e.g. of three, of five can also be applied depending on the installation site conditions, and transport or other circumstances.

In an embodiment of the invention having a raster allocation of two the surface area supported against the foundation is preferably 20-30% larger compared to a conventional sleeper projected to a single sleeper, (the degree of increase of the surface area is of course also dependent on the cross section of the opening end of the through-opening facing the support surface). In the case of sleepers with raster allocation of three, four, five or six, with identical through-opening dimensions this increase can even be as much as 40-50% projected to a single sleeper. Applying larger blocks (with higher raster allocation) is more favourable also because of the higher ratio of support surfaces. Frame rigidity is also much higher in this case, and can even be 2-4 times higher relative to conventional sleepers.

The sleeper according to the invention can be applied with all types of standard normal or grooved rails, or with any other non-standard rail types, constrained only by the operating conditions (velocity, axle load, traffic load). These are operator-dependent issues; members of a family of sleepers can be dimensioned for such standard cases or load cases governed by regulations.

Figure 8:
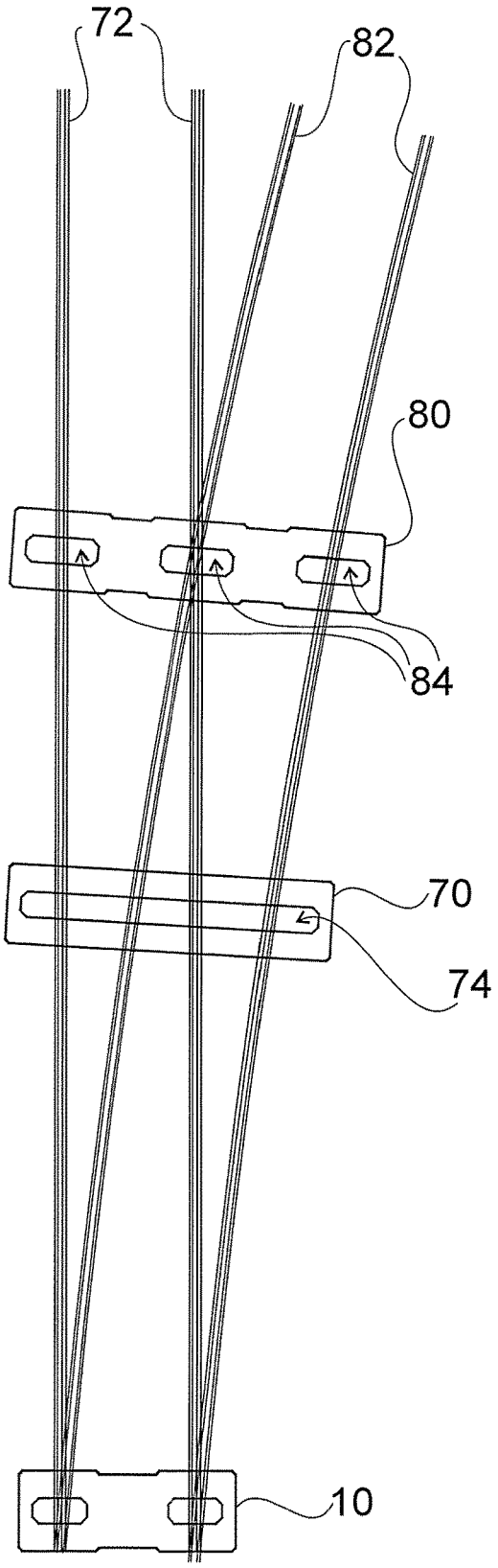
FIG. 8 is a schematic top drawing illustrating certain embodiments of the invention.

In FIG. 8, certain embodiments of the invention are illustrated installed at a switch (turnout). This installation location is a special one; as illustrated also in FIG. 8, various special configuration options can be applied, preferably in contrast with such sleepers that are to be arranged along a straight, generic track section. As it can be understood also by contemplating FIG. 8, in cases similar to the illustrated one it is more expedient to apply a sleeper with a raster allocation of two having an appropriately configured through-opening. Along generic, straight track sections it may be expedient to apply sleepers with a higher raster allocation, and, likewise, at any such locations for which their through-opening grid arrangement is suited.

In FIG. 8 a diverging track constituted by rails 82 branches out from a track made up of straight rails 72, i.e. FIG. 8 schematically illustrates a switch. Accordingly, in FIG. 8 not all sleepers are shown, and the connection points of rails 72, 82 are not illustrated in detail, and also the subcomponents of the switch are not shown; furthermore, the rails 72, 82 are also shown schematically in relation to the shown sleeper bodies (their path is shown but for example the details of their interconnections are not).

At the bottom of FIG. 8 such a portion of the switch is shown wherein the rails run together, this is where the movable rails of the switch (that are adapted for leading to the diverging rails 82 if the switch is set that way) and the fixed rails (continuing in rails 72 that form the straight track when the movable rails leading to the rails 82 are not used, i.e. removed from the straight rails) converge. Along this part (where the movable and fixed rails run along a common path, or diverge only to a minimal extent) such a sleeper body 10 is arranged that is shown also in FIGS. 1-2. In FIG. 8 the sleeper body 10 is arranged at that point where the sleeper body 10 can still be applied past the straight section without switch that terminates at the bottom part of the figure (of course the sleeper body 10 can also be applied along the straight section that does not contain a switch).

Along the switch, the straight rail sections—terminating in the rails 72 continuing along a straight path—and the diverging movable rail sections—terminating in diverging rails 82 (that for example lead to a turnout)—diverge more and more from each other. Along a track section, such a sleeper body—similar to the sleeper body 10—can also be applied that comprises two through-openings, each for one of the two rails, on which the through-openings are expanded sideways with respect to the rails, such that tamping can be performed when advancing along any of the tracks (if a crushed stone ballast is applied). After a certain distance, when the rails diverge to such an extent that overly wide through-openings would have to be applied, it becomes more expedient to apply such a through-opening that extends under all rails, i.e. under the rail laying band regions corresponding to both the fixed rails and the movable rails. A sleeper body 70 that is shown in FIG. 8 is such a sleeper body, wherein a single through-opening 74 extending under all of the rails is formed. The sleeper body 70 is therefore such an embodiment of the sleeper according to the invention wherein, in contrast to the embodiments illustrated in the other figures, separate through-openings are not formed corresponding to each rail laying band region, but a common through-opening is formed for all of them. There are more rail laying band regions on the sleeper body 70, the outside ones being situated at an appropriate distance from the edges of the through-opening 74. The sleeper body 70 is arranged in the switch at the location where fastening is applied also to the already curving rails, so it may even extend across four rail laying band regions, with the through-opening 74 also extending under them. The through-opening 74 is therefore a connected one, configured as if multiple aligned through-openings in a row were interconnected.

As shown in FIG. 8, at a still further section of the switch there occurs such a state wherein the rail starting from one of the movable blades of the switch intersects the other straight fixed rail (i.e. not the one from which it starts). This location is called a crossing. It can be seen that at the crossing a sleeper with a yet another configuration is applied: three fifth through-openings 84 are formed in a fifth sleeper body 80, one for each of the side rails and one under the crossing. Along this section it would not be worthwhile to apply a sleeper configured as the sleeper body 70 (i.e. having a common through-opening) because the regions not covered by the rails are sufficiently wide.

Before the crossing (between the curving rail of the switch and the two straight rails) and after it (the tracks are already separate) but still near the crossing it is expedient to apply an embodiment of sleeper body that is configured like the sleeper body 80, applying a preferably widened central through-opening, and arranging the other two through-openings corresponding to the outer rails, applying a sleeper having a lower lateral width before the crossing and one having a larger lateral width after it. Along the section after the crossing, where the rails are sufficiently spaced apart from each other, a sleeper body like the sleeper body 10 can be preferably applied.

As shown in FIG. 8, the sleeper bodies 70 and 80 are placed virtually tangentially with respect to the structure of the switch, i.e. the longitudinal direction of the oblong sleeper bodies 70, 80 is not perpendicular either to the rails joining the rails 72 or to the ones joining the rails 82, but it is arranged in a tangential direction relative to the entire switch structure (i.e. the two tracks thereof). The sleepers can be expediently arranged this way, but they could also be arranged such that the longitudinal direction of the sleeper bodies is set perpendicular to the straight rails, and optionally such that the longitudinal direction of the sleeper bodies is perpendicular to the diverging rails (this direction is defined, in the case of more than one through-openings, by the top view symmetry line crossing the through-openings, or, in the case of a single common oblong opening, the line of symmetry of the through-opening).

In the sleeper according to the invention, therefore, either a separate respective through-opening is formed for each rail, or a connected through-opening is formed between the rail fastening locations. When designing a track section, the locations requiring special configuration can be listed, and the appropriately dimensioned special sleepers can be manufactured for each location applying particular embodiments of the sleeper according to the invention, taking into account of course the type of rail fastening to be applied. After manufacturing the sleepers corresponding to a given track section, based on the design the intended and basic rail laying band regions and the seating regions corresponding to the rail fastenings can be assigned to the particular sleepers, i.e. their location relative to the through-openings can be determined.

Figure 10:
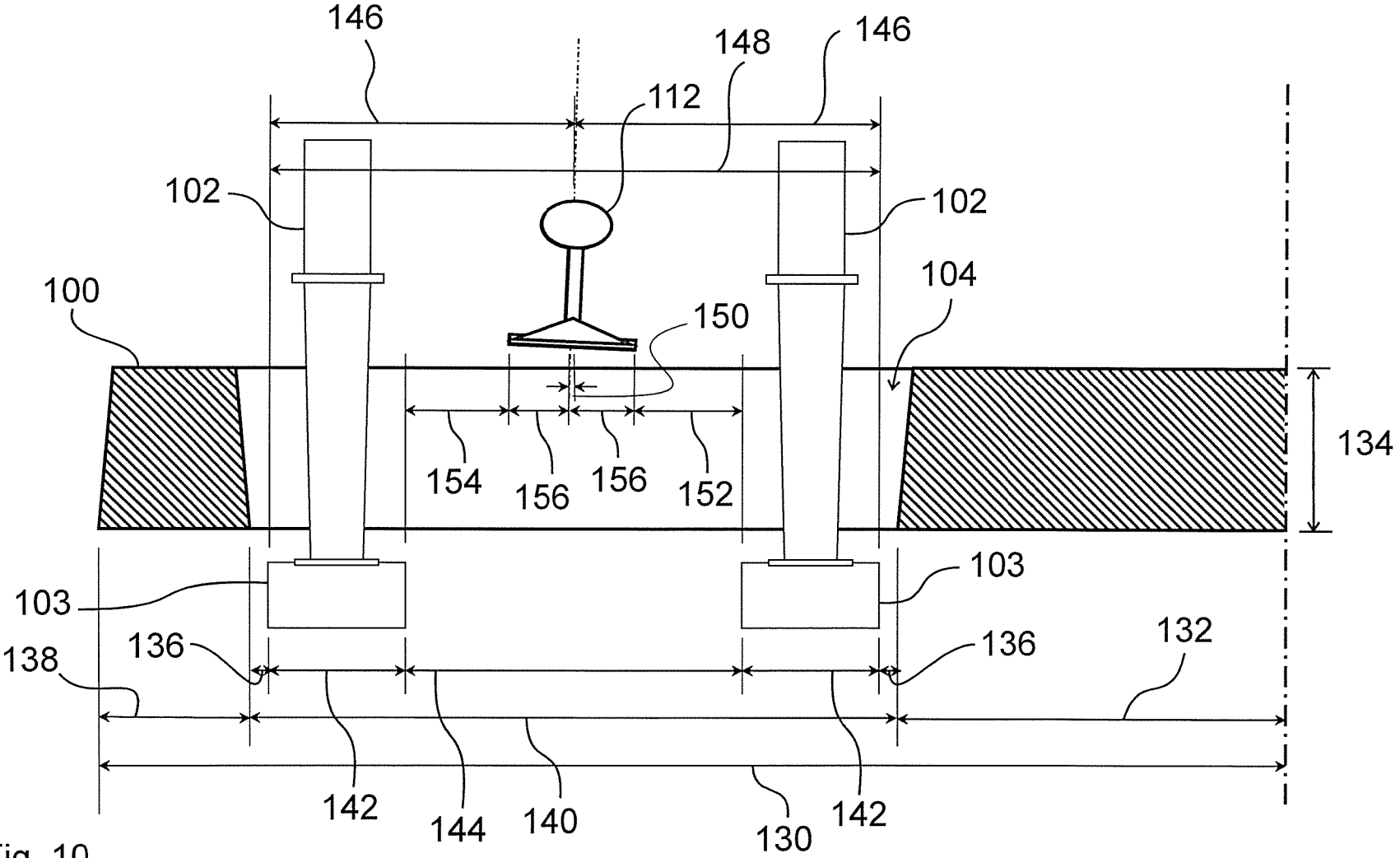
FIG. 10 illustrates in a sectional drawing the relationship of the through-opening and the tamper hammers in an embodiment of the sleeper according to the invention.

In FIG. 10 a further embodiment of the invention is illustrated in a sectional view. The section drawing crosses a through-opening 104 of a sleeper body 100 shown in FIG. 10, with the sleeper body 100 being shown cut along the central axis thereof, to which central axis the sleeper body 100 is symmetric (by mirroring the sleeper body 100 along the line indicated with a dash-dotted line on the right of the figure, the whole sleeper body 100 comprising two through-openings 104 is obtained).

FIG. 10 (and also the subsequent FIGS. 11 and 12) illustrates how in an example tamper hammers 102 (and tamper hammers 122)—which are not part of the invention—can be positioned in the through-opening 104 (the schematically illustrated tamper hammers 102, having a head portion 103, are considered to be to scale with respect to the sleeper). The receiving mechanism, i.e. the driving mechanism of the tamper hammers 102, is not shown in the figure.

In FIG. 10 the expedient arrangement of the tamper hammers 102, with the respective spacings relative to the rail 112 and the lateral walls of the through-opening 104, is also shown. The mutual distance of the tamper hammers 102 (in this case, two of them) is fixed in most of the cases, so they are situated with a certain spacing with respect to the rail 112. As illustrated in FIG. 10, the rail 112 is slightly inclined (its inclination is for example 1:40 relative to the vertical in FIGS. 10-12), so there is some degree of asymmetry in the configuration of the through-opening 104 with respect to the rail 112 and to the rail laying band region corresponding thereto.

For the distances marked in FIG. 10, the arrangement is illustrated by way of specific examples. Of course, other distance values can also be applied, but at the same time the sleeper is well characterised by the exemplary dimensions.

A dimension 130—shown at the bottom of FIG. 10—that is half the total width of the sleeper, is 1260 mm in an example, in which case the total width of the sleeper is 2520 mm, i.e. 2.52 m. According to the figure, this is made up of the following parts; it can be seen that the through-opening 104 narrows towards the bottom side of the sleeper body 100 (shown at the bottom of FIG. 10). A distance 132 between the centreline of the sleeper body 100 and the right edge of the opening 104 is 407.5 mm, a width 140 of the through-opening 104 at the bottom portion is 690 mm, and a distance 138 measured from the left edge of the through-opening 104 to the edge of the sleeper body 100 is 162.5 mm in an example. The sleeper body 100 has a thickness 134 with a value in this example of 180 mm (this value is suitable also for the examples implemented according to FIGS. 11 and 12).

According to FIG. 10, the width 140 is composed as follows: The head portion 103 of the tamper hammers 102 is spaced apart laterally from the edge of the through-opening 104 by a distance 136 at both sides (in the example, by 20-20 mm on each side, this is a safety gap). In the example, a width 142 of the head portion 103, measured along the section of FIG. 10, is 140 mm for both head portions 103, a distance 144 between the head portions 103 being 370 mm in the example.

According to the figure, the distance 144 is composed of the regions around the rail 112 as follows. A distance 156 between each of the lateral edges of the of the foot of the rail and the centreline of the rail 112 is 70-70 mm at both sides in the example. On the left, a distance 154 between the foot of the rail 112 and the projection of the head portion 103 of the tamper hammer 102 is 110 mm in the example. On the left, the edge of the foot of the rail 112 is at a distance 152—in the example, 120 mm—from the head portion 103 of the right-hand side tamper hammer 102.

A distance 150 shown in FIG. 10 (in the example, 5 mm) is the shift of the axis of the rail 112 applied due to the inclination of the rail 112 such that to restore the track gauge measured at the head of the rail 112 after applying an inclination to the rail 112. Due to the inclination of the rail 112, in practice the head of the rail 112, as well as the foot of the rail, leans inward, i.e. towards the track axis with respect to the vertical. Because of that, the feet of the rails are shifted with respect a rail in a vertical position. To compensate for this, the foot of the rail has to be shifted by the distance 150 to restore the track gauge (as measured at the head of the rail 112) that has narrowed down because of the inclination of the rail 112.

In FIG. 10 it is illustrated that a width 148 is covered by the tamper hammers 102 (taking into account also their head portions 103), which in the example is 650 mm. The highest point of the rail 112 is right at the middle of this width 148, i.e. the width 148 is divided by the axis of the rail 112 (which corresponds to the axis of symmetry of the rail 112 in the figure) in two distances 146 that in the example equal 325 mm.

In FIG. 10 it is illustrated that in the arrangement a slight asymmetry is introduced by inclining the rail 112, which results in that the distance 152 at the right of the rail 112 is slightly larger than the distance 154 at the left thereof.

Figure 11:
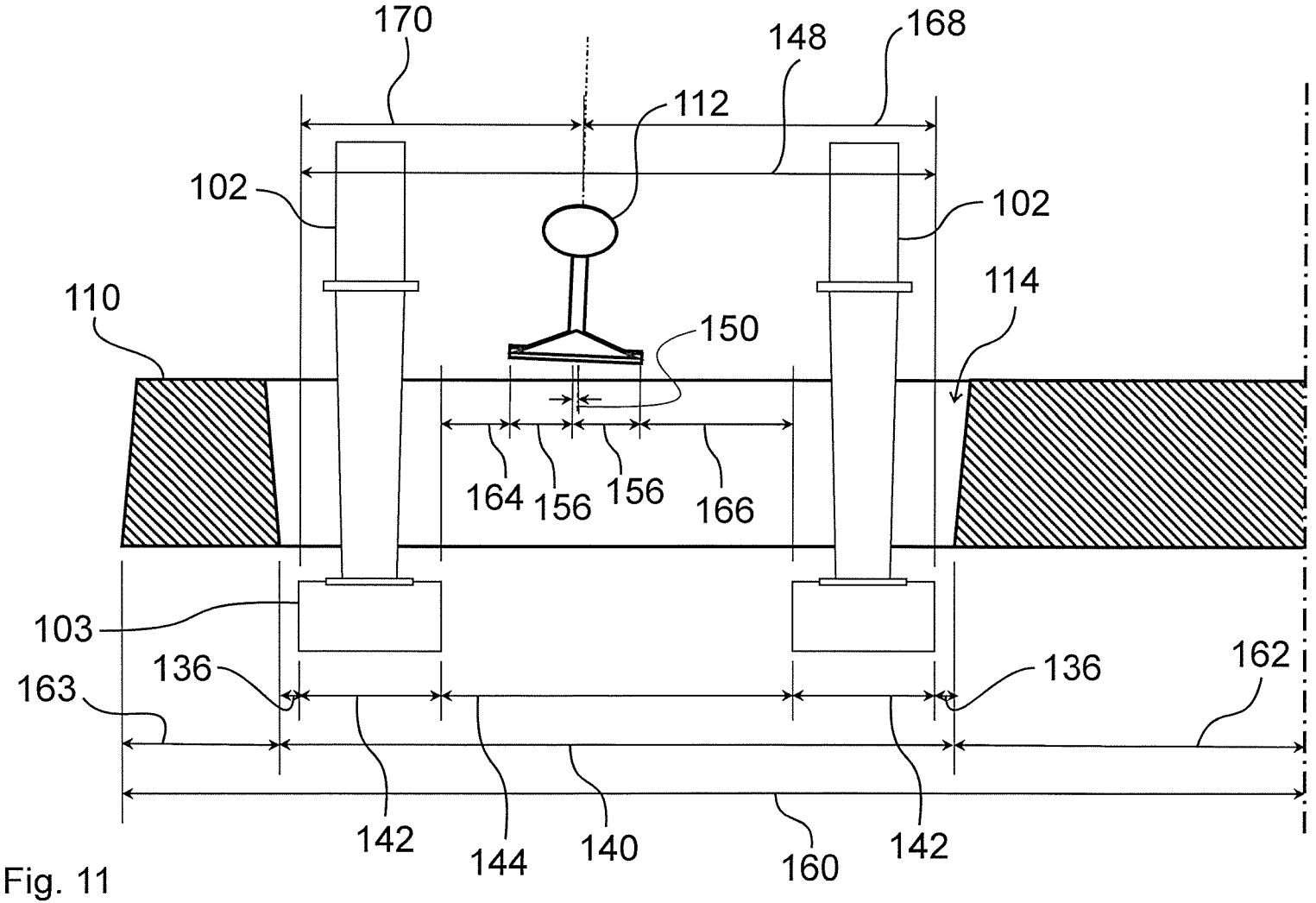
FIG. 11 illustrates in a sectional drawing the relationship of the through-opening and the tamper hammers in a further embodiment of the sleeper according to the invention.

FIG. 10 helps to understand a further embodiment illustrated in FIG. 11; in the embodiment according to FIG. 11 a much higher amount of asymmetry is introduced to the arrangement of the through-opening 114 about the rail 112 (and thus the rail laying band region), by modifying certain components of the arrangement, compared to what is shown in FIG. 10. An exceptionally advantageous result of increasing asymmetry is that the width of the sleeper for a given track gauge (rail distance) can be lower (compared to a sleeper with a through-opening arranged either symmetrically about the rail laying band region, or applying the slight asymmetry according to FIG. 10). Sleepers with lower width require the construction of narrower earthwork in the case of the crushed stone-ballast variant (significant savings can be made in the material consumption of the earthwork and the crushed stone ballast), or, with the variant arranged in a concrete foundation, a narrower concrete foundation is required. Accordingly, depending on the amount of asymmetry, this can even result in significant savings as far as a construction of a given track section is concerned.

As shown in FIG. 11, a greater asymmetry with respect to FIG. 10 is created by arranging the rail 112 closer to the left side (as shown in the figure) of the through-opening 114 compared to FIG. 10. Besides that, the tamper hammers 102 stay at the edge of the through-opening 114, so they have a laterally shifted arrangement with respect to the rail 112. As indicated also by the exemplary dimensions specified below, applying such a mutual arrangement of the rail 112 (so the rail laying band region) and the through-opening 114 it can be provided that the sleeper can be narrower in the direction of its width (one half of the sleeper body 110 is shown in FIG. 11 extending in this direction) with an unchanged track gauge value.

In an example, the embodiment of FIG. 11 has the following dimensions. In the example, a dimension 160 shown at the bottom of FIG. 11 is 1210 mm (the total width of the sleeper is 2420 mm, i.e. 2.42 m), so, thanks to the asymmetrical arrangement, 50 mm less than in the example implemented according to FIG. 10. Regarding the total width of the sleeper this results in a difference of 100 mm, i.e. 10 cm, so the width of the sleeper can be reduced that much (in the example, from 2.52 m to 2.42 m).

The dimensions of the through-opening 114 are the same as the dimensions of the through-opening 104, but it is arranged at a different position relative to the sleeper body 110 (the size of the sleeper body 110 itself is also different from that of the sleeper body 100). In the example that has already been introduced above specifying certain values, a distance 162 is 367.5 mm, i.e. the distance between the through-opening 114 and the (central) axis of the sleeper (plate-type sleeper) is smaller than in the embodiment according to FIG. 10 (the through-opening 114 extends inwards closer to the central axis of the sleeper). The through-opening 114 has a width 140, the size of which is, as with the through-opening 104 set to 690 mm when measured at the bottom side of the sleeper. The distance 162 and the width 140 are complemented by a distance 163 to make up the dimension 160; in the example the value of the distance 163 is 152.5 mm.

The tamper hammers 102 are arranged relative to the through-opening 114 similarly as relative to the through-opening 104, so in the example the values of the distance 136, width 142 and distance 144 seen in FIG. 11 are the same as specified above in relation to FIG. 10. In the example, the distances 150 and 156 related to the parameters of the rail 112 are also identical to what was specified in relation to FIG. 10 above. The distances determining the location of the rail 112 are at the same time different from what is specified in FIG. 10, which is clear when comparing FIGS. 10 and 11. A distance 164 of the foot of the rail 112 from the head portion 103 of the tamper hammer 102 on the left of the figure (towards the end of the sleeper) is 70 mm in the example, while a distance 166 shown on the right (towards the middle of the sleeper) is 160 mm (in comparison with the corresponding distances 154 and 152 of FIG. 10 it can be seen that the rail 112 is shifted to the left relative to the through-opening 114). In this example, the width 148 corresponding to the tamper hammers 102 is 650 mm, while in this embodiment the width 148 is divided by the highest point of the rail 112 (and thus the axis of the rail 112) into distances 168 and 170, which in this example are 365 mm and 285 mm, respectively. For the arrangement according to FIG. 11 the tamper hammers of the tamping machines are set asymmetrically with respect to the longitudinal axis of the rail 112.

As was mentioned above, the track gauge (the distance between the rails) is preferably identical in the embodiments of FIGS. 10 and 11, accordingly, in the example the same value can be obtained as the distance between the rail axes. In the example of FIG. 10, half of the distance between the rail axes is made up of the distances 132, 136, and 146, the sum of which in this example is 752.5 mm. In the example of FIG. 11, half of the distance between the rail axes is constituted by the sum of the distances 162, 136, and 163, which is also 752.5 mm, so the total distance between the rail axes is 1505 mm in both cases.

Figure 12:
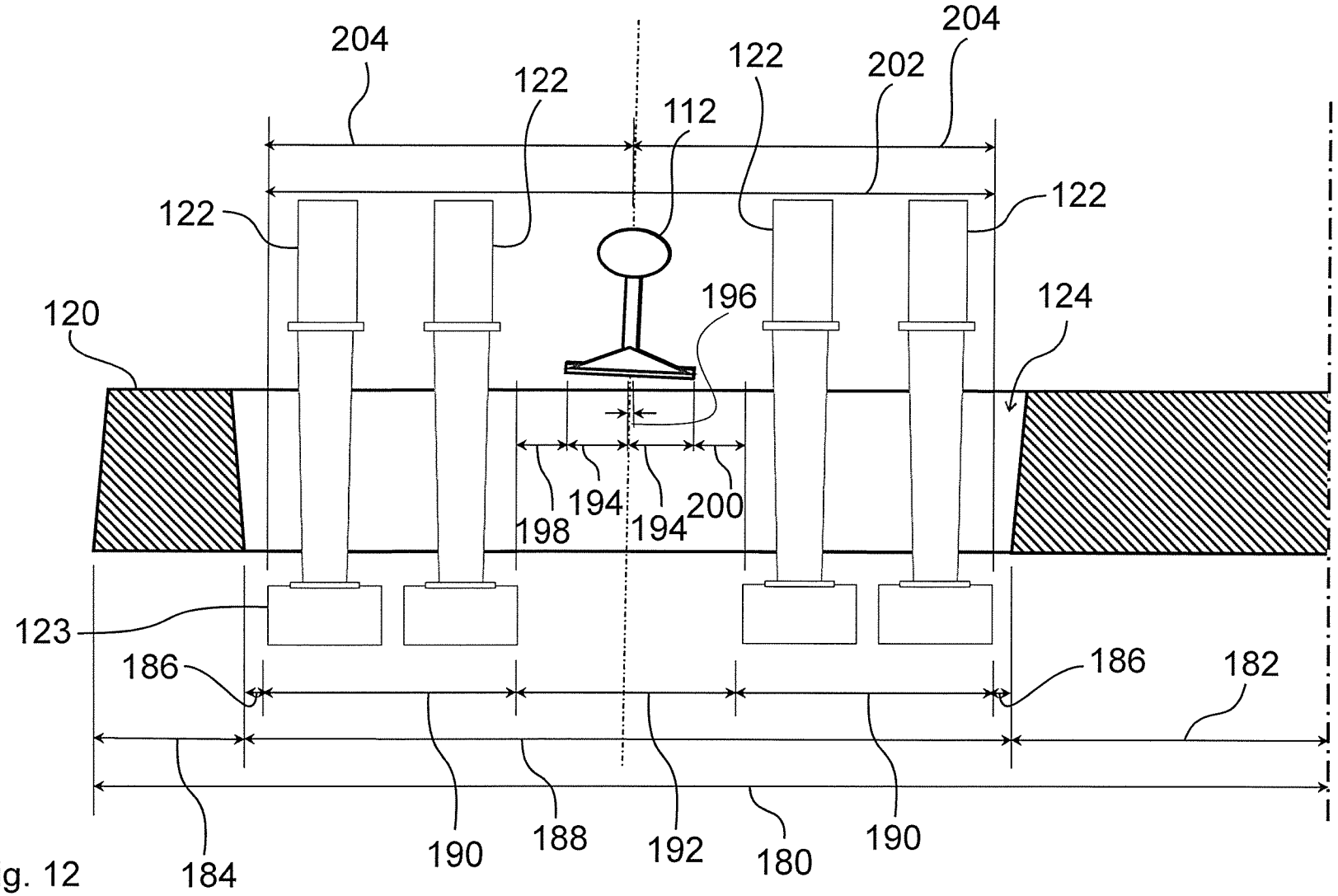
FIG. 12 illustrates in a sectional drawing the relationship of the through-opening and the tamper hammers in a yet further embodiment of the sleeper according to the invention.

In FIG. 12 another embodiment is illustrated, showing in a sectional view not two but four tamper hammers 122 (a number of tamping machines have such a configuration of tamper hammers). In this embodiment, therefore, a through-opening 124 adapted for receiving more tamper hammers is formed according to the description below: Corresponding to the more than one tamper hammers 122, in this embodiment the through-opening 124 is wider than the through-openings 104 and 114, with the sleeper body 120 also being wider than the sleeper body 100 and the sleeper body 110. Such modifications therefore allow for including more tamper hammers; dimensions of an appropriately implemented example are given below in order to describe the present embodiment.

In an example implemented according to FIG. 12, a dimension 180 is 1320 mm which therefore corresponds to half the total width of the sleeper (the total width of the sleeper is 2640 mm, i.e. 2.64 m). In this example, it is constituted by a distance 182 (345 mm), a width 188 (815 mm) and a distance 184 (160 mm). In this embodiment, too, the dimension 180 can be specified applying the values defined by the tamper hammers 122; in the example, the dimension 180 is constituted by the following:

- distances 186 (at both sides) characteristic of the distance between the bottom edge of the through-opening 124 and the head portion 123 of the tamper hammer 122 proximate thereto, measured in the section according to FIG. 12,
- two pairs of tamper hammers 122, the width 190 of each of the pairs being—taking into account the head portions 123—265 mm in the example, and
- distance 192 between the pairs of tamper hammers 122, which is 245 mm in the example.

As illustrated in FIG. 12, the distance 192 is made up as follows. A rail 112 is preferably applied also in this embodiment, the distance characteristic of which in this embodiment being: the distances 194 and 196 being 70 mm and 5 mm, respectively. The left edge of the foot of the rail 112 is at a distance 198 from the head portion 123 of the tamper hammer 122 nearest to it, while its right edge is at a distance 200 from the head portion 123 of the tamper hammer 122 located nearest to it in the opposite direction; the distance 198 and the distance 200 being in this example 47.5 mm and 57.5 mm, respectively. A slight asymmetry is therefore present in this embodiment, too.

In this embodiment, the width 188 is composed of the distances 186 at both sides, and of the width 202, which latter is the total width of the tamper hammers 122, also taking into account their head portions 123. In the example, the width 202 is 775 mm, which is divided into two distances 204 (the value of the distances 204 in the example is 387.5 mm) by the topmost point of the rail 112 (i.e. the axis of the rail 112).

In the embodiment of FIG. 12, a distance equalling half of the distance between the rail axes is composed of the distances 182, 186, 204, and, using the values of the above described example is 752.5 mm, so the total distance between the rail axes is, in this example, 1505 mm. Accordingly, in an embodiment of the invention it is possible to arrange more than two tamper hammers preferably applying a track gauge that is identical to the one above. By comparison with FIGS. 10 and 11 it can be comprehended that a greater amount of asymmetry can be introduced into the arrangement of the rail (and so the rail laying band region) and the through-opening (the through-opening 124 could be arranged such that the rail 112 would be pushed forward to the left, preferably closer to the nearest tamper hammer 122, which would allow the reduction of the width of the sleeper body 120 of FIG. 12) also in this embodiment.

Figure 13A:
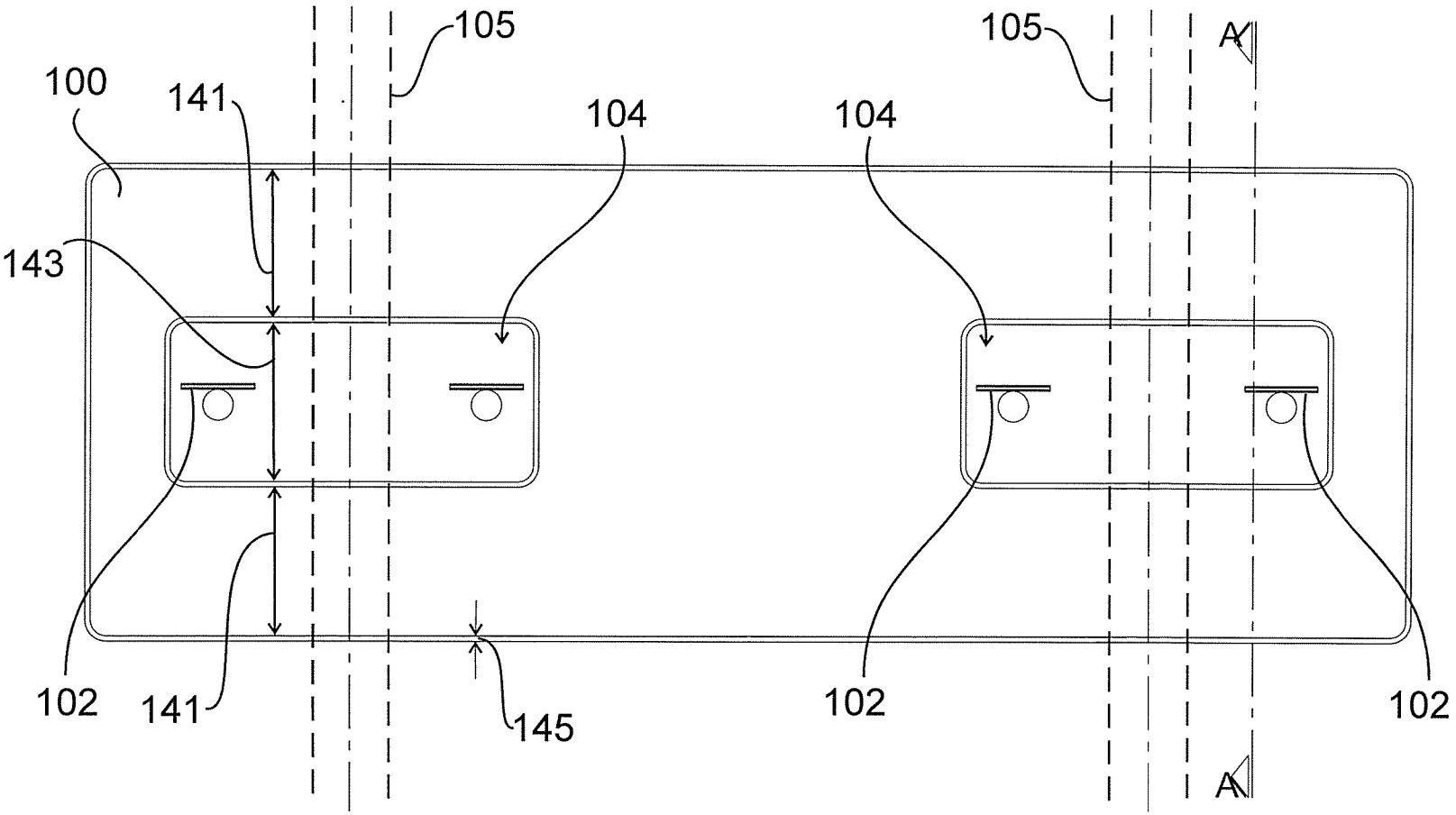
FIGS. 13A and 13B illustrate, in a top drawing and in a sectional drawing, the embodiment of FIG. 10, FIGS. 14A and 14B illustrate, in a top drawing and in a sectional drawing, the embodiment of FIG. 11.
Figure 13B:
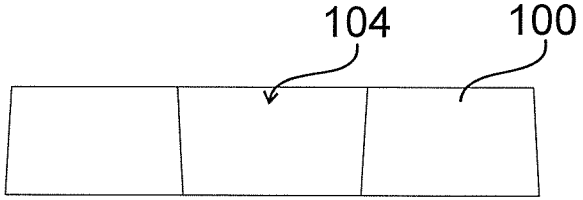

In the subsequent figures the embodiments of FIGS. 10-12 are illustrated in top view (and also in sectional views). In FIG. 13A the embodiment of FIG. 10 is illustrated in top view. As opposed to FIG. 10, in FIG. 13A the entire sleeper body 100 is shown, so the two through-openings 104 can be observed. The double lines indicating the edges of the sleeper body 100 and the through-opening 104 indicate inclined edges which are not vertical (these can be observed in FIG. 10). In FIG. 13B the section A-A indicated in FIG. 13A is illustrated. Accordingly, the sleeper body 100 and the through-opening 104 is shown in FIG. 13B in the corresponding sectional view (the section line A-A crosses the through-opening 104).

In FIG. 13A the tamper hammers 102 extending into the through-openings 104 are illustrated. As it was mentioned above, of course the tamper hammers 102 are not part of the invention, and are shown with the purpose of illustrating their applicability with the sleeper when it is laid in a crushed-stone ballast, and a compaction of the ballast is required.

A basic rail laying band region 105 is also illustrated in FIG. 13A. In accordance also with the terminology included above, this is a basic rail laying band region (it can also be called a rail contour), the width of which is given by the width of the foot of the rail. The intended rail laying band region (see also above) is wider than that, because it also covers those regions which would be covered by a curving or obliquely arranged rail. However, for illustrating the symmetries and the arrangement it is sufficient to illustrate only the basic rail laying band regions in FIGS. 13A, 14A and 15.

In FIG. 13A, therefore, it can be observed that—if they are present—the tamper hammers 102 are arranged in a slightly asymmetrical manner (almost symmetrically) at both sides of the basic rail laying band region 105, at such a distance therefrom that is also shown in FIG. 10. In FIG. 13A there are shown dimensions 141 which encompass the through-opening 104 along the direction of the longitudinal axis of the rail. The dimension 141 measured at the top of the sleeper body 100 is 280 mm in this example. In FIG. 13A there is shown a dimension 143 of the through-opening 104 along the direction of the longitudinal axis of the rail, which is measured at the bottom of the sleeper body 100, and in this example is 300 mm. This dimension, too, is chosen such that the tamper hammers can operate unhindered, i.e. that they fit into the through-opening also in this direction. Because the configuration of the arrangement according to FIGS. 14A and 15 is similar in this regard, these dimensions are also applicable therein.

In FIG. 13A that illustrates the inclined sides of the sleeper body 100 and the through-opening 104, a dimension 145 is also indicated; the dimension 145 having a value of 10 mm (this value is applied at all locations where the inclined sides are shown in double lines in FIG. 10). Based on the inclined walls corresponding to the dimension 145 in the figure it is clear whether the dimensions 141 and 143 are measured on the top side or on the bottom side of the sleeper body 100, because at the edge of the sleeper body 100 the inclined side "leads up to" the top side, and then, in the through-opening 104 it "leads down to" the bottom side, and also vice versa on the other side of the through-opening 104. These dimensions, as specified in FIG. 13A, can be applied mutatis mutandis also to FIGS. 14A and 15.

Figures 14A, 14B:
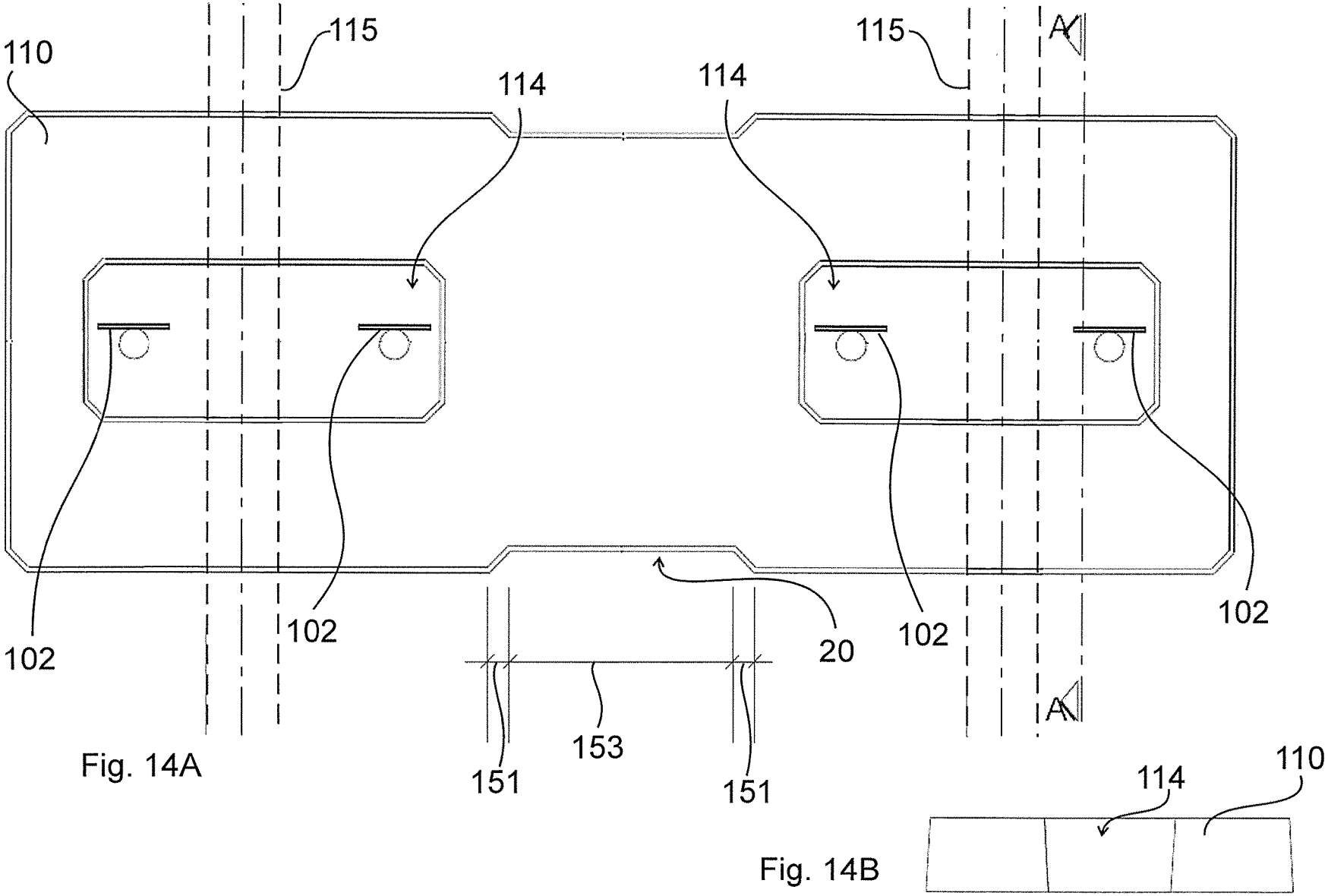
Figure 15:
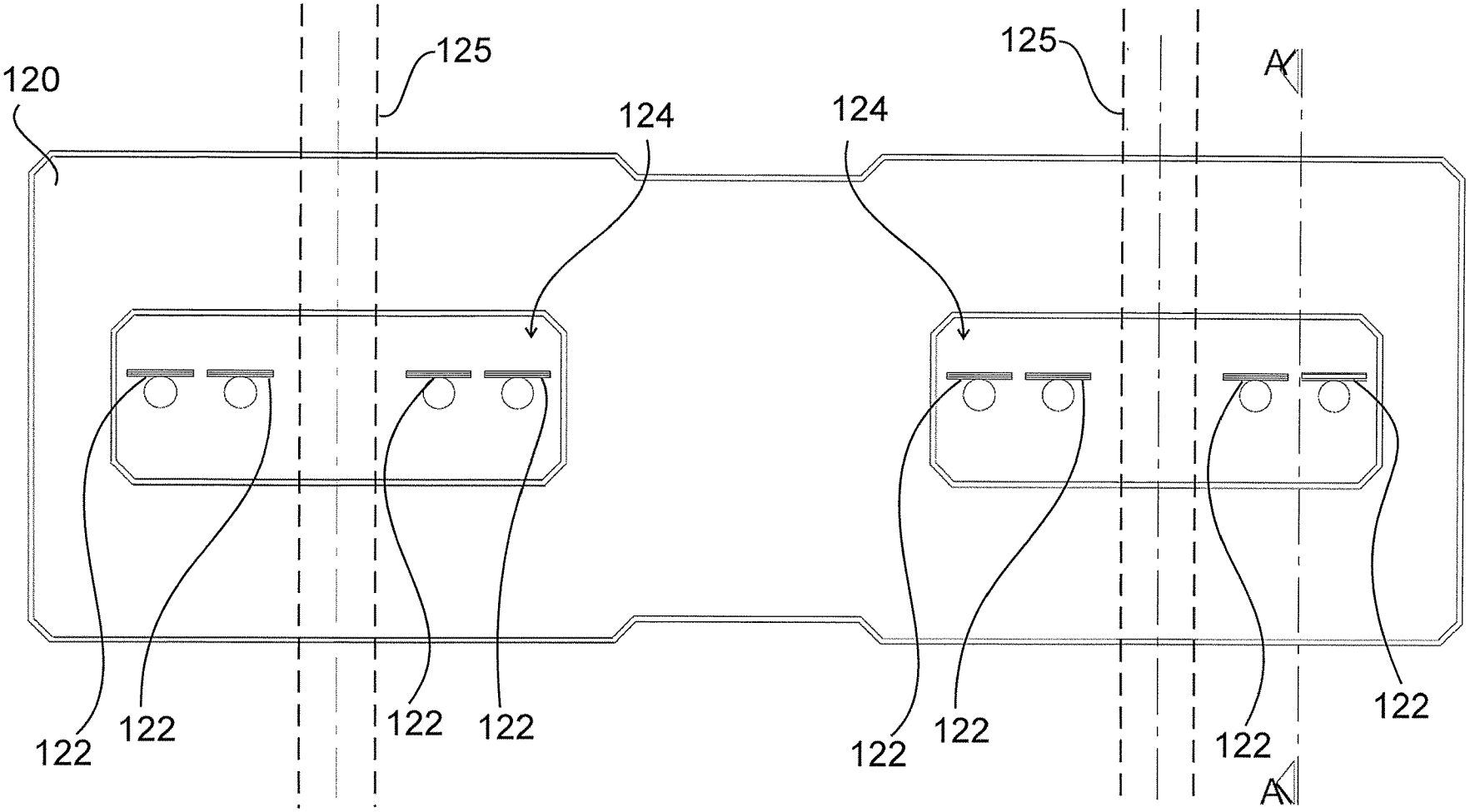
FIG. 15 illustrates the embodiment of FIG. 12 in a top drawing.

In FIG. 14A the embodiment of FIG. 11 is shown in top view. In FIG. 14A there can be observed that the tamper hammers 102 can be arranged asymmetrically around a basic rail laying band region 115. Due to the identical track gauge, the distances between the two basic rail laying band regions 105 and between the two basic rail laying band regions 115 are identical, i.e. the through-openings 114 shown in FIG. 14A extend more between the rail laying band regions, i.e. towards the middle of the sleeper body than do the through-openings 104.

In FIG. 13A the dimensions of the lateral indents 20 of the sleeper body 110 are also indicated. Accordingly, the lateral indent 20 has a width 153, while the sections leading to the lateral indent 20 have a width 151. The exemplary values of the widths 151 and 153 are 40 mm and 540 mm, respectively. In FIG. 14B a view similar to the view of FIG. 13B is illustrated.

FIG. 15 illustrates the embodiment of FIG. 12 in top view. In the figure there can be observed the arrangement of the tamper hammers 122 around a basic rail laying band region 125.

As illustrated in FIGS. 13A-13B, 14A-14B and 15, in the embodiments according to FIGS. 10-12 it holds true that lateral farther-extensions of the through-openings (i.e. the through-openings 104, 114, 124) from the intended rail laying band region are asymmetrical with respect to the intended rail laying band region. Although in FIGS. 13A, 14A and 15 only the basic rail laying band regions 105, 115, 125 are shown, due to the asymmetry the through-openings 104, 114, 124 will also be asymmetrical with respect to the intended rail laying band regions that are somewhat wider to the basic rail laying band regions 105, 115, 125.

In the embodiment of FIGS. 10-12 it preferably also holds true that the sleeper has two intended rail laying band regions (in such a case, therefore, there are exactly two intended rail laying band regions formed on the top side of the sleeper; the below references to one of them also relate to the other), with the through-openings 104, 114, 124 being formed in a row extending in a transverse direction thereto, and the lateral first farther-extensions of the through-openings 104, 114, 124 from the intended rail laying band region in a first direction pointing towards the other intended rail laying band region (in the figures these always appear as farther-extensions towards the right side) are larger than the second lateral farther-extensions thereof at the opposite edge (side) of the intended rail laying band region in a second direction extending opposite the first direction (these are the left-side farther-extensions).

The farther-extensions of the through-openings can for example be best observed in the top figures. Of these, because FIG. 11 has the greatest asymmetry of FIGS. 10-12, it can be best observed in FIG. 14A that corresponds thereto that the through-opening 114 extends out more towards the other rail laying band region (which is a basic rail laying band region, but—as it was mentioned above—for interpreting the farther-extensions can also be considered instead of the somewhat wider intended rail laying band region) than in the opposite direction (i.e. towards the edge of the sleeper).

Examining the values corresponding to FIGS. 10 and 12, however, it can be seen that they also have such an asymmetry that the farther-extension of the through-opening towards the other rail laying band region is larger. According to the definition above, the first direction can be considered as a direction transverse to the intended rail laying band region (typically lying at a right angle with respect to the longitudinal direction thereof) and pointing towards the other intended rail laying band region. The other direction is opposite thereto, so also transverse with respect to the intended rail laying band region, but does not point towards the other intended rail laying band region but towards the outside edge of the sleeper.

Of the embodiments of FIGS. 10-12, in the embodiment of FIG. 11 it preferably also true that the difference between the first farther-extension and the second farther-extension for each of the particular through-openings 114 (the first farther-extension is larger than the second, so the difference is positive, this is true for all examples described in relation to FIGS. 10-12) is at least 5% of the largest extension of the second opening end of the through-opening 114 on the bottom side in the transverse direction with respect to the intended rail laying band region (this is the largest extension of the bottom side of the opening transversely to the rail, i.e. the width of the bottom side that is marked in the figure: the width 140, which is compared with the difference between the first and the second farther-extension).

In a direction transverse to the rail laying band region—due to the typical "cut-off" or bevelling of the corners of the through-openings—their largest extension can be measured at the bottom side at the central portion of the opening sides parallel to the rail laying band region, and corresponds to the length of the (longer) side—extending transversely to the rail laying band region—of the rectangle-like through-opening (because in FIGS. 10-12 the section crosses the through-opening at such a location, i.e. not at the bevelling, it is this side of the rectangle-like through-opening that can be seen therein). The degree of asymmetry—and the farther-extensions at both sides—are determined by the mutual arrangement of the rail (and accordingly the rail laying band region) and this side. The distances marked in the figures are characteristic of this configuration, with the shift of the rail relative to this side being also shown in the figures. The asymmetry can also be characterised with the displacement/shift of the rail axis with respect to the centre of this side.

To characterize the amount of asymmetry it is an obvious choice to compare the difference between the first and second farther-extensions and the lateral extension of the through-opening (measured at the bottom side); however, the asymmetry can also be characterised differently (for example by measuring the lateral extension of the through-opening at the top side). If necessary, above the values related to asymmetry, and the limits specified above can be recalculated according to this alternative approach.

Using the exemplary values specified in the embodiment of FIG. 11, the difference of the right-side and the left-side farther-extensions is identical with the difference of the distances 164 and 166, because the other constituent values of the farther-extension are the same (of these the smaller is definitely larger than the width of the intended rail laying band region, because this distance extends as far as the tamper hammer). Comparing that to the value of the width 140 a value of 90/690*100%=13.0% is obtained in the arrangement according to FIG. 11, calculating the percentage according to the above definition. The value characteristic of the amount of asymmetry in such a manner is 10/690*100%=1.45% in the arrangement of FIG. 10, while in the arrangement of FIG. 12 it is 10/815*100%=1.23%. In the case of such arrangements the source of asymmetry is essentially the inclination of the rail 112, so if a significant shortening of the lateral dimension of the sleeper is desired, then it is preferable to provide a greater amount of asymmetry, for example greater than 5%. According to the above calculation, the asymmetry percentage is preferably lower than 50%, so for example 5-50%.

As indicated also by the exemplary values included above, in the embodiment of FIG. 11—in addition to the "at least 5%" condition—it also holds true that the difference between the first farther-extension and the second farther-extension for each of the through-openings 114 is 10-30% of the largest extension of the second opening end of the through-opening 114 on the bottom side in the transverse direction with respect to the intended rail laying band region. Accordingly, the asymmetry is preferably between 10% and 30%, but can also be set between 10-20% or 10-15%. The upper and lower limits of the different asymmetry ranges can be freely combined. As it was underlined above, from the aspect of cost savings it is of utmost importance that asymmetry is achieved, and preferably as great as possible. Of course, asymmetry has a natural limit posed by the fact that the rail cannot be shifted sideways relative to the through-opening by an arbitrarily great amount (cf. FIGS. 10 and 11), so the difference of the first and second farther-extensions cannot increase without a limit.

As illustrated also by FIGS. 10-12, a requirement for the lateral farther-extensions of the through-openings is that the farther-extension has to be large enough to allow for safely inserting the tamper hammers beside the rail. No teaching proposing such an asymmetrical configuration has been found in any prior art document.

The above description of the other embodiments can be applied mutatis mutandis to the embodiments of FIGS. 10-12, provided that there are no limiting circumstances. This is also true vice versa; asymmetry can also be introduced in the embodiments presented before the embodiments of FIGS. 10-12, of course even in the embodiments of FIGS. 6A-7, or in the sleeper body 80 shown in FIG. 8. In the case of the latter, the description related to the directedness of asymmetry (the through-openings preferably extend more towards the centre of the sleeper) is preferably applied to the two outside through-openings 84, while the central through-opening 84 preferably has a symmetrical configuration.

The mode of industrial application of the invention according to the above description follows from the features of the invention. As can be seen from the description above, the invention achieves its object in a particularly preferable manner compared to the prior art. The invention is, of course, not limited to the preferred embodiments described in details above, but further variants, modifications and developments are possible within the scope of protection determined by the claims.

LEGENDS

10 (first) sleeper body
12 rail
14 (first) through-opening
15 (first) side
16 (first flat) lateral wall portion
17 (second flat) lateral wall portion
18 rail fastening
19 fastening plate
20 lateral indent
21 resilient layer
22 (first) wall bend line
24 (second) wall bend line
25 cast portion
26 intermediate layer
28 base layer
30 (second) sleeper body
33 fastening hole
34 (second) through-opening
35 injection opening
37 lifting link
40 (first) side length
42 (second) side length
44 (first) distance
46 (second) distance

48 (third) distance
50 rail axis
52 (fourth) distance
54 extension (measured transverse to rail laying band region)
56 extension (measured along a rail laying band region)
58 (fifth) distance
60 (third) sleeper body
63 fastening hole
64 (third) through-opening
65 injection opening
67 lifting link
70 (fourth) sleeper body
72 rail
74 (fourth) through-opening
80 (fourth) sleeper body
82 rail
84 (fifth) through-opening
90 seating region
92 (first) rail contour
94 (second) rail contour
95 (intended) rail laying band region
96 (third) rail contour
100 sleeper body
102 tamper hammer
103 head portion
104 through-opening
105 (basic) rail laying band region
110 sleeper body
112 rail
114 through-opening
115 (basic) rail laying band region
120 sleeper body
122 tamper hammer
123 head portion
124 through-opening
125 (basic) rail laying band region
130 dimension
132 distance
136 distance
138 distance
140 width
142 width
144 distance
146 distance
148 width
150 distance
152 distance
154 distance
156 distance
160 dimension
162 distance
163 distance
164 distance
166 distance
168 distance
170 distance
180 dimension
182 distance
184 distance
186 distance
188 width
190 width
194 distance
196 distance
198 distance
200 distance
202 width
204 distance

The invention claimed is:

1. A sleeper, comprising:

a sleeper body having top and bottom sides, and effective rail laying band regions on the top side, wherein for each of the effective rail laying band regions a rail is adapted to reside thereon, and at least two seating regions correspond to and overlap with each of the effective rail laying band regions, each seating region adapted to have a respective rail fastener secured thereto;

for each of the effective rail laying band regions, from the top side to the bottom side, wherein each respective through opening corresponds to a rail, and the respective through opening extends further in both lateral directions beyond the respective rail and the corresponding effective rail laying band region, and with two through openings arranged in a row that extends transverse to the effective rail laying band regions; and wherein for each through opening the cross sectional area thereof increases on at least a section from the bottom side to the top side of the sleeper body, and further, wherein the lateral extensions of the through opening are asymmetrical with respect to the corresponding effective rail laying band region, with a first farther extension that extends in a first direction being greater than a second farther extension that extends in a second direction.

2. The sleeper according to claim 1, characterised in that the cross-section of the through-opening, being parallel to a plane corresponding to the bottom side, increases uniformly from the bottom side towards the top side (15) of the sleeper body.

3. The sleeper according to claim 2, characterised in that the through-opening has a rectangular or rectangle-like the cross-section parallelly to a plane corresponding to the bottom side.

4. The sleeper according to claim 2, characterised in that lateral walls of the through-opening interconnecting the top side and the bottom side are determined by flat lateral wall portions, the through-opening has an opening axis perpendicular to the top side, and the inclination of the flat lateral wall portions relative to the opening axis is between 1:20 and 1:10.

5. The sleeper according to claim 1, characterised in that the difference between the first farther-extension and the second farther-extension for each of the through-openings is at least 5% of the largest extension of the second opening end of the through-opening on the bottom side in the transverse direction with respect to the intended rail laying band region.

6. The sleeper according to claim 1, characterised in that the difference between the first farther-extension and the second farther-extension for each of the through-openings is 10-30% of the largest extension of the second opening end of the through-opening at the bottom side in the transverse direction with respect to the intended rail laying band region.

7. The sleeper according to claim 1, characterised in that the through-are formed in a row extending in a transverse direction to the intended rail laying band region, the through-openings has a rectangular or rectangle-like the cross-section parallelly to a plane corresponding to the bottom side, and the sum of the largest extensions of the second opening ends of the through openings formed in a row on the bottom side in the transverse direction with respect to the intended rail laying band region is 40-70% of the extension of the sleeper body in the transverse direction with respect to the intended rail laying band region.

8. The sleeper according to claim 1, characterised in that the largest extension of the second opening ends of the through-openings on the bottom side in the direction of the intended rail laying band region is 50-60% of the distance between the centres of the adjacent intended seating regions.

9. The sleeper according to claim 1, characterised in that the sleeper body has a continuous lateral wall extending parallel to the direction of the intended rail laying band region, interconnecting the top side and bottom side thereof, and having a length along the intended rail laying band region being equal to or larger than the distance between the centres of the adjacent intended seating regions.

10. The sleeper according to claim 1, characterised in that a resilient layer is arranged on the bottom side of the sleeper body and/or on a lateral wall of the through opening interconnecting the top side and the bottom side of the sleeper body.

11. The sleeper according to claim 1, characterised in that three or more intended seating regions, each being applicable for a respective rail fastening, are arranged corresponding to each intended rail laying band region overlapping therewith.

12. The sleeper according to claim 1, characterised in that an injection opening interconnecting the top side and the bottom side of the sleeper body is formed in the sleeper body separately from the through-opening.

13. The sleeper according to claim 1, characterised in that lifting links adapted for receiving levelling screws are connected to the top side of the sleeper body.

14. The sleeper according to claim 1, characterised in that the sleeper body is formed from concrete.

* * * * *